US011479898B2

(12) United States Patent
Funakoshi et al.

(10) Patent No.: US 11,479,898 B2
(45) Date of Patent: Oct. 25, 2022

(54) WASHING APPARATUS

(71) Applicant: Samsung Electronics Co., Ltd., Suwon-si (KR)

(72) Inventors: Hidekazu Funakoshi, Yokohama (JP); Hiroshi Katsumoto, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/110,728

(22) Filed: Dec. 3, 2020

(65) Prior Publication Data

US 2021/0180234 A1 Jun. 17, 2021

(30) Foreign Application Priority Data

| | | |
|---|---|---|
| Dec. 12, 2019 | (JP) | JP2019-224579 |
| Mar. 9, 2020 | (JP) | JP2020-039801 |
| Nov. 13, 2020 | (KR) | 10-2020-0151637 |

(51) Int. Cl.

| | |
|---|---|
| ***D06F 37/40*** | (2006.01) |
| ***D06F 34/18*** | (2020.01) |
| ***D06F 37/30*** | (2020.01) |
| *D06F 103/02* | (2020.01) |
| *D06F 23/02* | (2006.01) |

(52) U.S. Cl.

CPC ..... *D06F 37/40* (2013.01); *D06F 34/18* (2020.02); *D06F 37/304* (2013.01); *D06F 23/02* (2013.01); *D06F 2103/02* (2020.02)

(58) Field of Classification Search

CPC ..... D06F 37/40

See application file for complete search history.

(56) References Cited

FOREIGN PATENT DOCUMENTS

| | | | |
|---|---|---|---|
| EP | 2728051 | B1 | 12/2017 |
| JP | 2009-247722 | A | 10/2009 |
| JP | 2015-157025 | A | 9/2015 |
| JP | 6379436 | B2 | 9/2015 |
| JP | 2018-86232 | A | 6/2018 |
| KR | 10-2017-0010031 | A | 1/2017 |
| KR | 10-2019-0024687 | A | 3/2019 |
| KR | 10-2019-0039018 | A | 4/2019 |
| WO | 2015/158044 | A1 | 10/2015 |

OTHER PUBLICATIONS

International Search Report dated Mar. 22, 2021, issued in International Patent Application No. PCT/KR2020/017571.

*Primary Examiner* — Jason Y Ko

(74) *Attorney, Agent, or Firm* — Jefferson IP Law, LLP

(57) ABSTRACT

A washing apparatus is provided. The washing apparatus includes a tub, a drum configured to be rotatable in the tub, a pulsator configured to be rotatable in the drum, a driver configured to drive the drum and the pulsator, and a controller configured to control the driver to rotate the pulsator to a second direction while rotating the drum to a first direction. The controller controls the driver to drive the pulsator based on a position of laundry accommodated in the drum during a rotation of the drum.

8 Claims, 18 Drawing Sheets

WASHING APPARATUS

CROSS-REFERENCE TO RELATED APPLICATION(S)

This application is based on and claims priority under 35 U.S.C. § 119(a) of a Japanese patent application number 2019-224579, filed on Dec. 12, 2019, in the Japan Patent Office, of a Japanese patent application number 2020-039801, filed on Mar. 9, 2020, in the Japan Patent Office, and of a Korean patent application number 10-2020-0151637, filed on Nov. 13, 2020, in the Korean Intellectual Property Office, the disclosure of each of which is incorporated by reference herein in its entirety.

BACKGROUND

1. Field

The disclosure relates to a drum type washing machine.

2. Description of Related Art

In a drum type washing machine, laundry and a small amount of water are accommodated in a drum in a tub arranged horizontally. The drum type washing machine is configured to wash laundry by a mechanical action of lifting and dropping the laundry (so-called, "beating-washing") during a rotation of the drum. Therefore, in the drum type washing machine, an amount of water for washing is reduced in comparison with a vertical type washing machine.

A drum-type washing machine capable of independently rotating a drum and a pulsator is known. Particularly, Japanese unexamined patent application publication number 2018-86232 discloses a technique for improving cleaning performance by performing contra-rotating washing in which washing is performed by rotating a drum and a pulsator to opposite directions in a drum type washing machine.

The above information is presented as background information only to assist with an understanding of the disclosure. No determination has been made, and no assertion is made, as to whether any of the above might be applicable as prior art with regard to the disclosure.

SUMMARY

However, in a drum type washing machine of the related art, power consumption increases due to contra-rotating washing in which washing is performed by rotating a drum and a pulsator to opposite directions.

Aspects of the disclosure are to address at least the above-mentioned problems and/or disadvantages and to provide at least the advantages described below. Accordingly, an aspect of the disclosure is to provide a drum type washing machine capable of reducing power consumption while maintaining excellent washing performance of contra-rotating washing.

Additional aspects will be set forth in part in the description which follows and, in part, will be apparent from the description, or may be learned by practice of the presented embodiments.

In accordance with an aspect of the disclosure, a washing apparatus is provided. The washing apparatus includes a tub, a drum configured to be rotatable in the tub, a pulsator configured to be rotatable in the drum, a driver configured to drive at least one of the drum and the pulsator, and a controller configured to control the driver to rotate the pulsator to a second direction while rotating the drum to a first direction. The controller controls the driver to drive the pulsator based on a position of laundry accommodated in the drum while rotating the drum.

The controller may control the driver to change a rotational speed of the pulsator based on a position of the laundry accommodated in the drum while rotating the drum.

The controller may control the driver to rotate the pulsator at a first speed based on that the laundry is located under a first reference position while rotating the drum, and the controller may control the driver to rotate the pulsator at a second speed, which is higher than the first speed, based on that the laundry is located above a second reference position, which is higher than the first reference position, while rotating the drum.

The controller may control the driver to rotate the pulsator at a first speed based on that the laundry is located at a low point of the drum while rotating the drum, and the controller may control the driver to rotate the pulsator at a second speed, which is higher than the first speed, based on that the laundry is located at a high point of the drum while rotating the drum.

The controller may control the driver to change a torque limit of the driver, which is for rotating the pulsator, based on a position of the laundry accommodated in the drum while rotating the drum.

The controller may control the driver to change a rotational speed of the pulsator based on a drive current of the driver for rotating the drum.

The controller may control the driver to rotate the pulsator at a first speed based on that the drive current is greater than a first reference current during one rotation cycle of the drum, and the controller may control the driver to rotate the pulsator at a second speed, which is higher than the first speed, based on that the drive current is less than a second reference current, which is less than the first reference current, during one rotation cycle of the drum.

The controller may control the driver to rotate the pulsator at a first speed based on that the drive current is a maximum value during one rotation cycle of the drum, and the controller may control the driver to rotate the pulsator at a second speed, which is higher than the first speed, based on that the drive current is a minimum value during one rotation cycle of the drum.

The controller may control the driver to change a torque limit of the driver, which is for rotating the pulsator, based on a drive current of the driver for rotating the drum.

In a washing cycle or a rinsing cycle of the washing apparatus, the first direction may be different from the second direction, and in a spinning cycle of the washing apparatus, the first direction may be the same as the second direction.

In accordance with another aspect of the disclosure, a control method of a washing apparatus is provided. The control method includes a tub, a drum configured to be rotatable in the tub, and a pulsator configured to be rotatable in the drum, the control method includes rotating the pulsator to a second direction while rotating the drum to a first direction, and varying a rotation of the pulsator based on a position of laundry accommodated in the drum while rotating the drum.

The varying a rotation of the pulsator may include changing a rotational speed of the pulsator based on a position of the laundry accommodated in the drum while rotating the drum.

The changing of a rotational speed of the pulsator may include rotating the pulsator at a first speed based on that the laundry is located under a first reference position while rotating the drum, and rotating the pulsator at a second speed, which is higher than the first speed, based on that the laundry is located above a second reference position, which is higher than the first reference position, while rotating the drum.

The changing of a rotational speed of the pulsator may include rotating the pulsator at a first speed based on that the laundry is located at a low point of the drum while rotating the drum, and rotating the pulsator at a second speed, which is higher than the first speed, based on that the laundry is located at a high point of the drum while rotating the drum.

The varying of a rotation of the pulsator may include changing a torque limit of the driver, which is for rotating the pulsator, based on a position of the laundry accommodated in the while rotating the drum.

The varying of a rotation of the pulsator may include changing a rotational speed of the pulsator based on a drive current for rotating the drum.

The changing a rotational speed of the pulsator may include rotating the pulsator at a first speed based on that the drive current is greater than a first reference current during one rotation cycle of the drum, and rotating the pulsator at a second speed, which is higher than the first speed, based on that the drive current is less than a second reference current, which is less than the first reference current, during one rotation cycle of the drum.

The changing a rotational speed of the pulsator may include rotating the pulsator at a first speed based on that the drive current is a maximum value during one rotation cycle of the drum, and rotating the pulsator at a second speed, which is higher than the first speed, based on that the drive current is a minimum value during one rotation cycle of the drum.

The varying a rotation of the pulsator may include changing a torque limit of the driver, which is for rotating the pulsator, based on a drive current for rotating the drum.

In a washing cycle or a rinsing cycle of the washing apparatus, the first direction may be different from the second direction, and in a spinning cycle of the washing apparatus, the first direction may be the same as the second direction.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
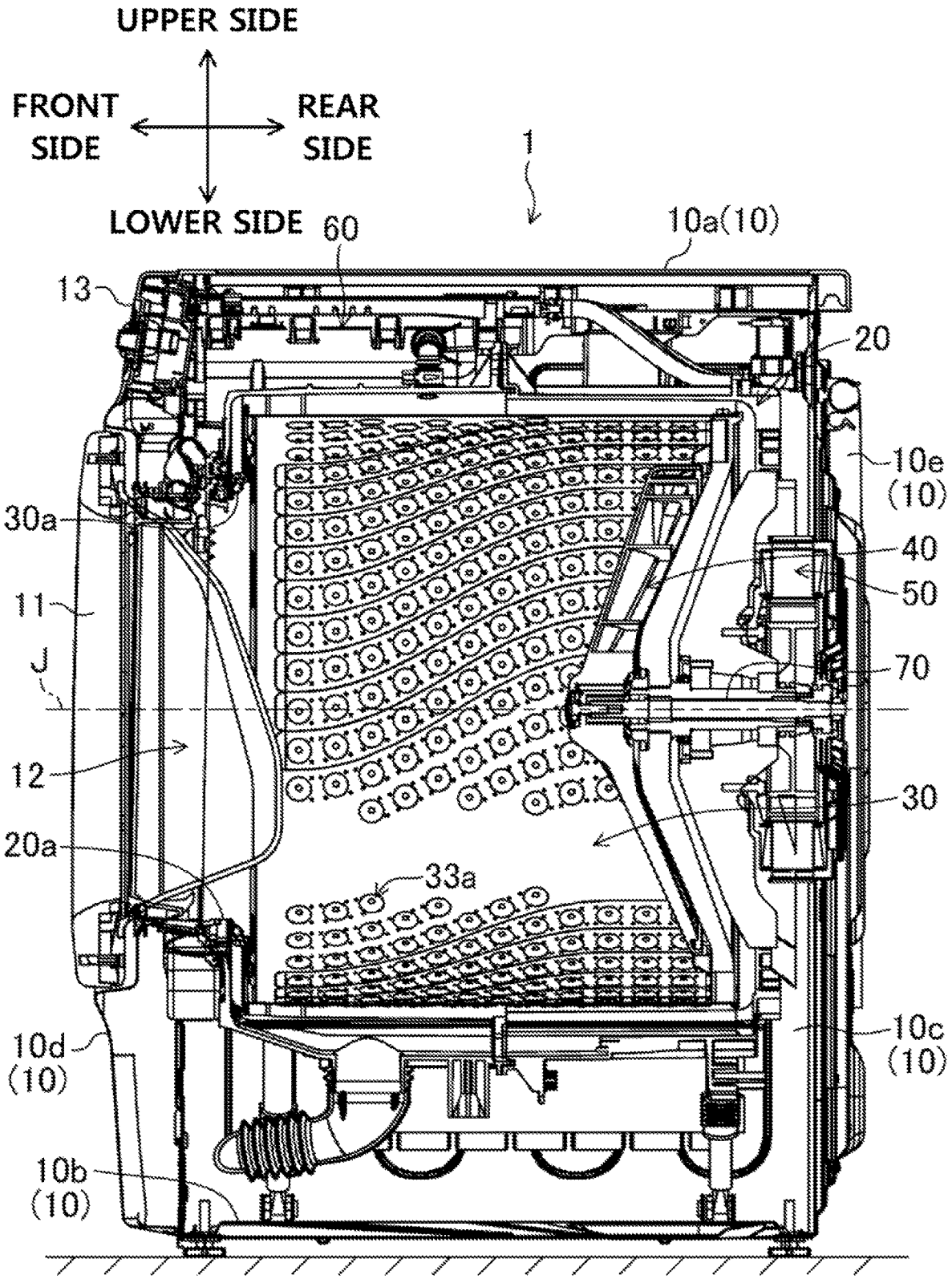
FIG. 1 is a schematic sectional view of a drum type washing machine according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Additionally, various embodiments will now be described more fully hereinafter with reference to the accompanying drawings. The various embodiments may, however, be embodied in many different forms and should not be construed as being limited to the embodiments set forth herein. These embodiments are provided so that this disclosure will be thorough and complete and will fully convey the various embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting.

Reference will now be made in detail to the various embodiments of the disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Basic Configuration of Drum Type Washing Machine

Figure 2:
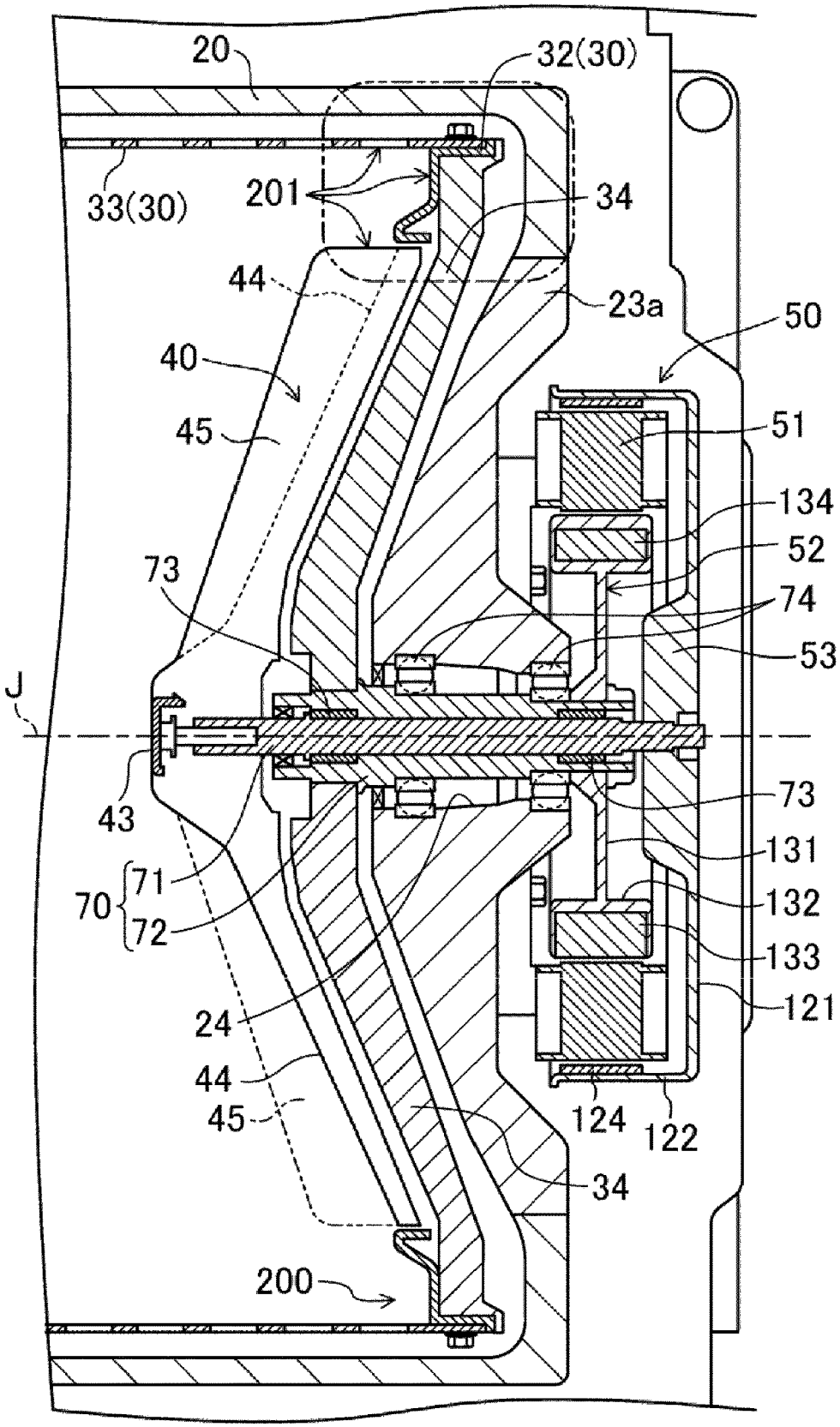
FIG. 2 is an enlarged view of a main portion of FIG. 1 according to an embodiment of the disclosure.

FIGS. 1 and 2 illustrate a drum type washing machine according to various embodiments of the disclosure.

Referring to FIGS. 1 and 2, a drum type washing machine 1 may include a housing 10, a tub 20, a drum (rotating tub) 30, a pulsator (agitator) 40, a motor (drive device) 50, and a controller (control device) 60. The drum type washing machine 1 is configured to automatically perform (fully automatic) each cycle of washing, rinsing, and spinning according to a set program.

The housing 10 may have a rectangular box shape having an upper surface 10*a*, a lower surface 10*b*, a pair of left and right surface 10*c* and 10*c*, a front surface 10*d*, and a rear surface 10*e*. At approximately the center of the front surface 10*d*, a circular inlet 12 configured to be opened and closed by a door 11 is formed. Laundry may be entered and exited through the inlet 12. A manipulator 13, in which a switch is disposed, is installed on an upper part of the front surface 10*d*, and the controller 60 is embedded in the rear thereof.

The tub 20 may be a cylindrical container, which includes a bottom including an opening 20*a* having a diameter smaller than an inner diameter, at one end thereof. The opening 20*a* may face the inlet 12. The tub 20 is installed in an inside of the housing 10 in such a way that the tub 20 is arranged in a longitudinal direction to allow a center line of the tub 20 is in a substantially horizontal direction. Water for washing and rinsing is stored in a lower portion of the tub 20 during a washing cycle or a rinsing cycle.

Referring to FIG. 1, a side of the inlet 12 in the horizontal direction is defined as "front", the opposite side is defined as "rear", a side, on which washing water or rinsing water is stored in the tub 20, in a vertical direction is defined as "lower", and the opposite side is defined as "upper".

The drum 30 may be a cylindrical container including an opening 30*a* formed at one end of the drum 30 and a bottom (lower portion) at the other end of the drum 30. The drum 30 is accommodated in the tub 20 in such a way that the opening 30*a* faces forward. The opening 30*a* has an inner diameter less than that of a drum body (wrapper 33 to be described later). The drum 30 is rotatable around a rotation axis J extending in a front and rear direction, and the cycle such as washing, rinsing and spinning is performed in a state in which laundry is accommodated in the drum 30. On an inner circumferential surface of the drum 30, a baffle is provided.

Figure 4:
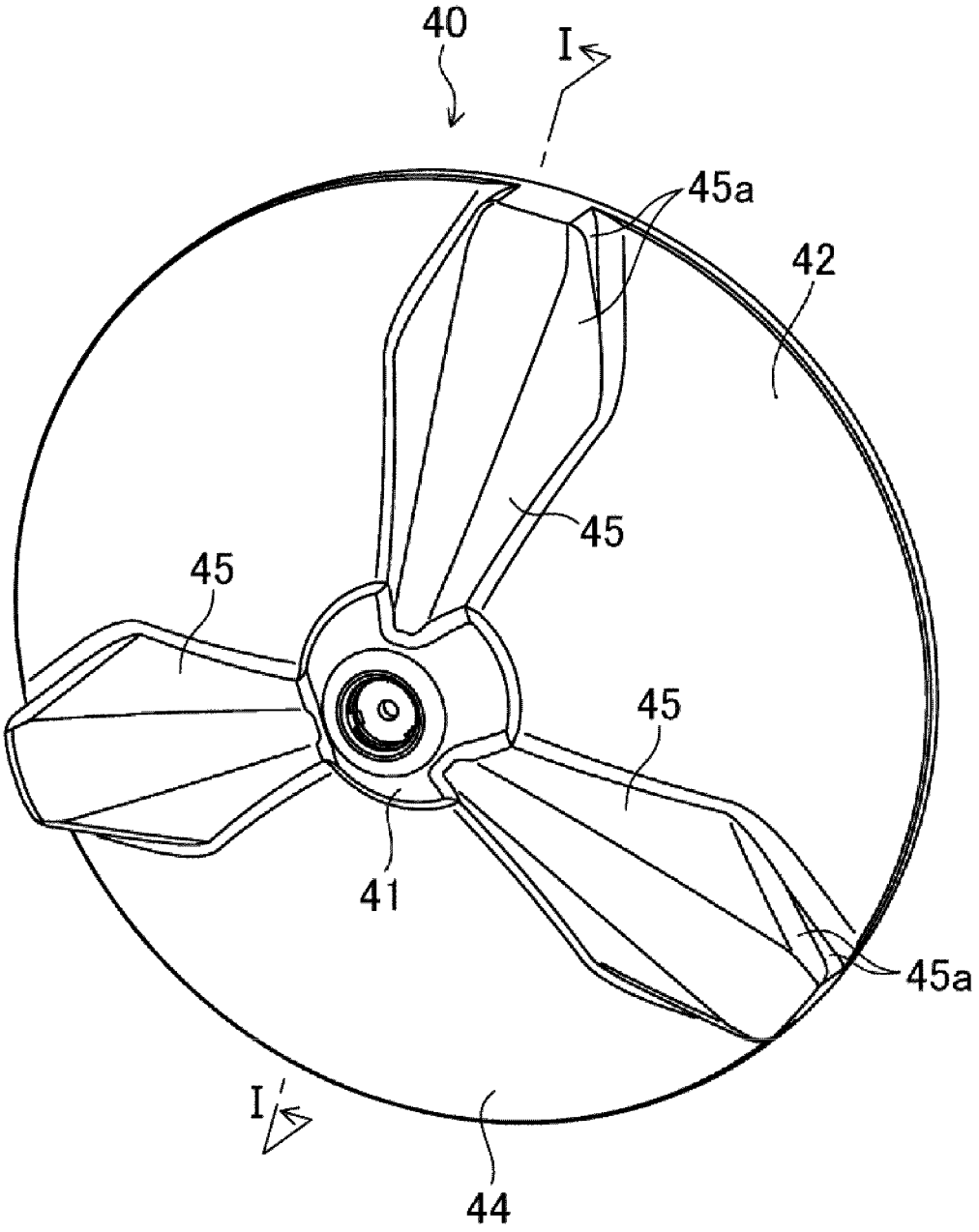
FIG. 4 is a schematic perspective view of a pulsator of a drum type washing machine according to an embodiment of the disclosure.
Figure 5:
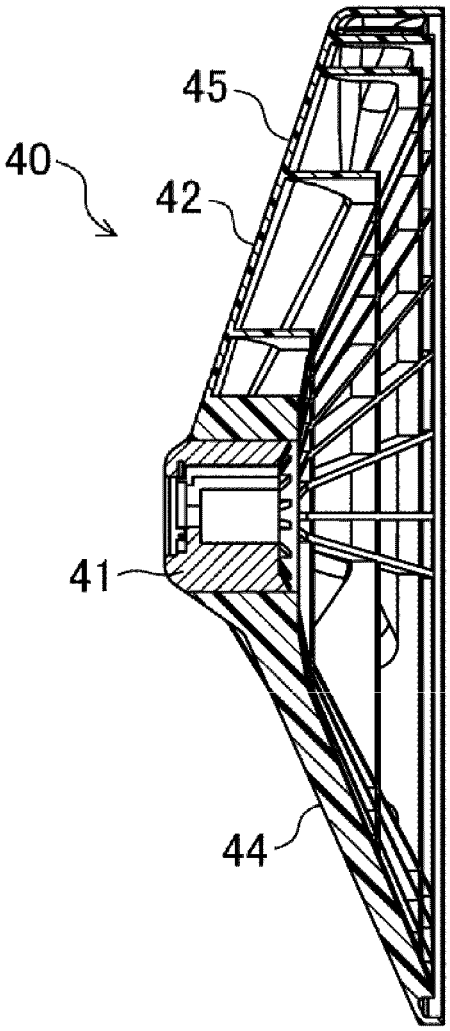
FIG. 5 is a sectional view taken along line I-I of FIG. 4 according to an embodiment of the disclosure.
Figure 6:
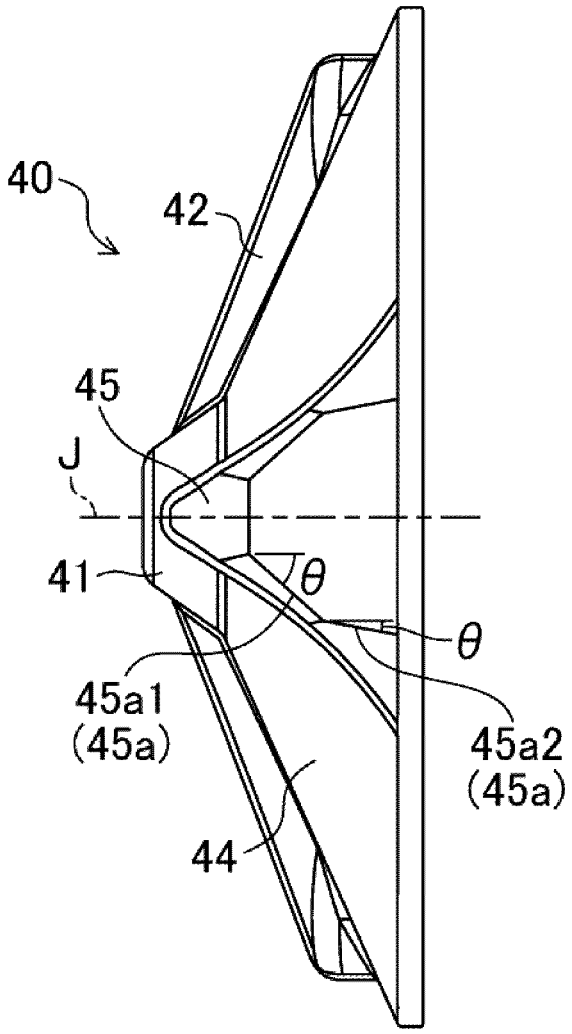
FIG. 6 is a schematic side view of a pulsator of a drum type washing machine according to an embodiment of the disclosure.

Referring to FIGS. 4 to 6, the pulsator 40 may be a disc-shaped member including a substantially conical front surface with a low apex, and disposed at the bottom of the drum 30. Protrusions (blades) 45 extending in a radial direction are provided on a front surface of the pulsator 40. The pulsator 40 is rotatable about the rotation axis J independently of the drum 30.

Referring to FIG. 2, a double shaft 70 including an inner shaft 71 and an outer shaft 72 is installed by penetrating the bottom of the tub 20 with respect to the rotation axis J. The outer shaft 72 is a cylindrical shaft having an axial length shorter than that of the inner shaft 71. The inner shaft 71 is rotatably supported inside the outer shaft 72 through an inner bearing 73. The outer shaft 72 is rotatably supported on a bearing housing 23*a* of the tub 20 through an outer bearing 74.

The drum 30 is connected to and supported at an upper end of the outer shaft 72, and the pulsator 40 is connected to and supported at an upper end of the inner shaft 71. The outer shaft 72 and the inner shaft 71 are connected to the motor 50 disposed on the rear side of the tub 20.

The motor 50 may independently drive each of the outer shaft 72 and the inner shaft 71. The controller 60 includes hardware, such as a CPU (processor) or memory, and software, such as a control program. The controller 60 comprehensively controls the drum-type washing machine 1, and automatically drives each cycle, such as washing, rinsing, and spinning according to an instruction input from the manipulator 13.

Detailed Configuration of Drum Type Washing Machine

Figure 3A:
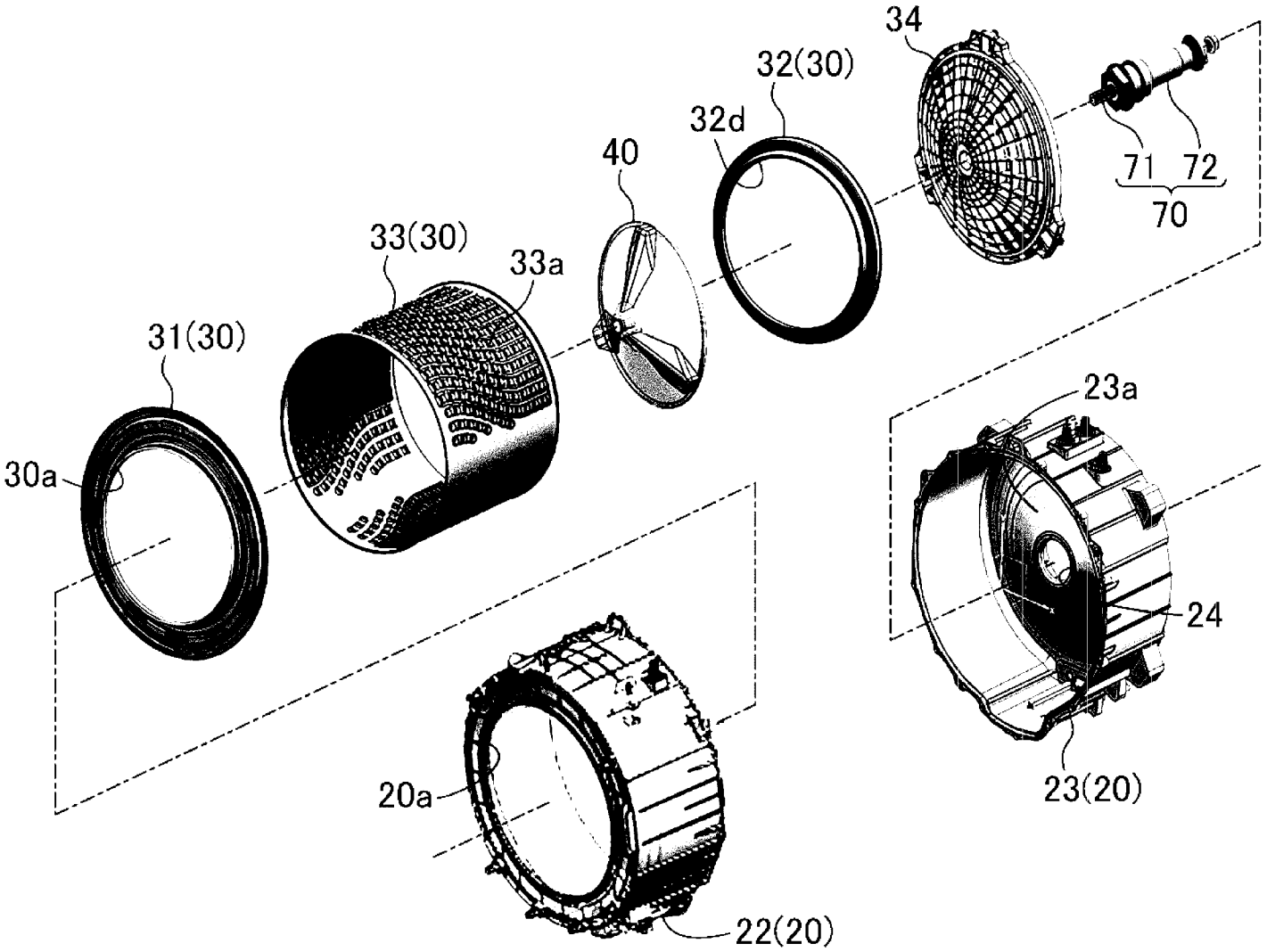
FIG. 3A is an exploded perspective view of a main portion of a drum type washing machine according to an embodiment of the disclosure.

FIG. 3A is an exploded perspective view of a main portion of a drum type washing machine according to an embodiment of the disclosure.

Referring to FIG. 3A, the drum 30 includes an annular (ring) drum front 31 in which the opening 30*a* is formed, a ring-shaped drum back 32 facing the drum front 31 in a front and rear direction, and a cylindrical wrapper 33 configured to connect the drum front 31 to the drum back 32.

A number of water-through holes 33*a* penetrating in and out of the wrapper 33 are formed, and water stored in the tub 20 may be introduced into the drum 30 through the water-through holes 33*a*. Each water-through hole 33*a* has a substantially burring shape and protrudes in a spherical shape on the inner surface side of the drum 30. The water-through hole 33*a* may be formed in the drum front 31 or the drum back 32 or the pulsator 40 as well as the wrapper 33.

The drum front 31 and the wrapper 33 are integrally formed or detachably connected by caulking or screwing. Similarly, the wrapper 33 and the drum back 32 are integrally formed or detachably connected by caulking or screwing.

The drum 30 is fixed to the outer shaft 72 through a disk-shaped flange shaft (flange member) 34 assembled at the bottom thereof. For work efficiency during assembly, the flange shaft 34 and the outer shaft 72 are integrated by pressing the outer shaft 72 into the flange shaft 34, or the outer shaft 72 and the flange shaft 34 are integrated through the insert molding.

In a case in which the flange shaft 34 is assembled to the drum 30 and integrated, the flange shaft 34 may be fixed by being coupled to the outer circumferential side of the wrapper 33 with screws to facilitate assembly. In a case in which the drum 30 is composed of a plurality of parts, a bending portion of the drum back 32 may be fastened together between the wrapper 33 and the flange shaft 34. The drum back 32 may be first fixedly assembled to the flange shaft 34, and then the wrapper 33 may be fastened to the flange shaft 34.

Figure 3B:
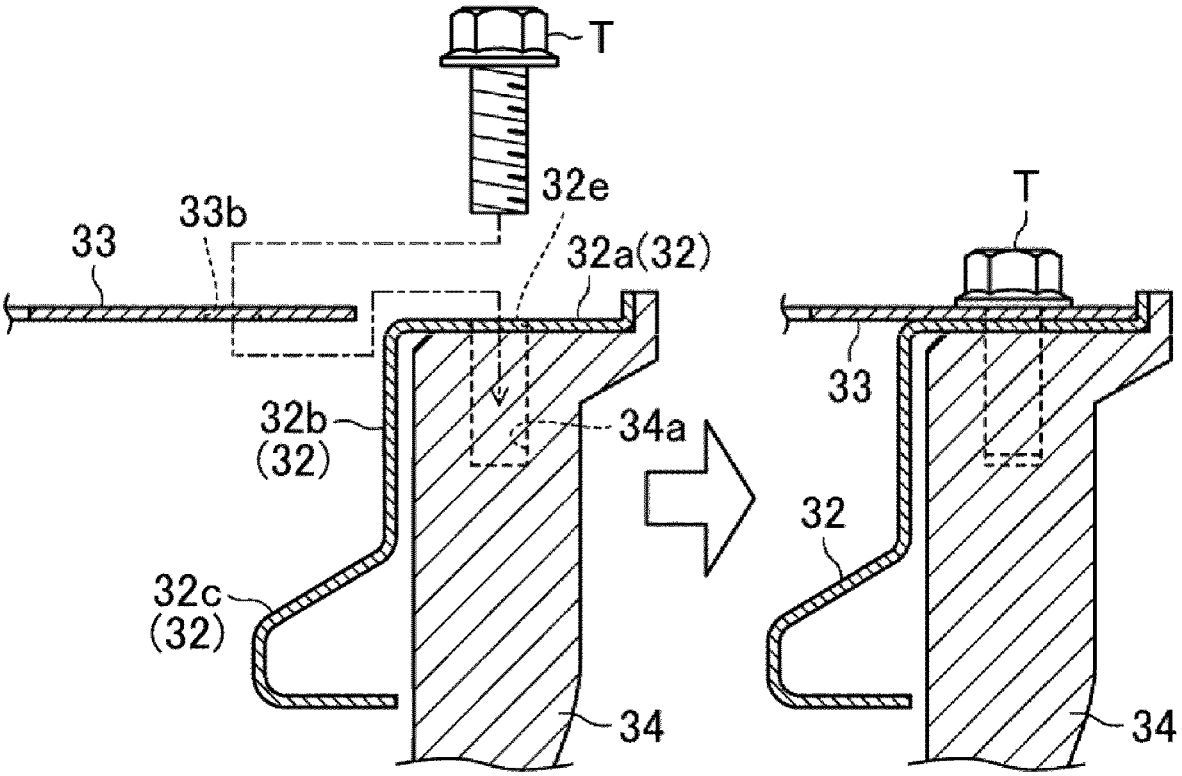
FIG. 3B is an explanatory view illustrating assembly of a part surrounded by a two-dot chain line in FIG. 2 according to an embodiment of the disclosure.

FIG. 3B is an explanatory view illustrating assembly of a part surrounded by a two-dot chain line in FIG. 2 according to an embodiment of the disclosure.

Referring to FIG. 3B, the assembly of the drum 30 and the flange shaft 34 of the drum washing machine 1 is shown. The wrapper 33 or the drum back 32 may be formed by bending or pressing a metal plate. Therefore, by mounting the annular drum front 31 and the drum back 32 to a front end inner edge and a rear end inner edge of the cylindrical wrapper 33 and by integrating the drum front 31, the drum back 32, and the wrapper 33, it is possible to secure the strength and rigidity of the drum 30.

Further, the drum back 32 includes a cylindrical outer fitting portion 32*a* and an annular flange portion 32*b* protruding inward from a front end of the outer fitting portion 32*a*. A protrusion 32*c* protruding to be gently inclined toward the front side is formed on a central side of the annular flange portion 32*b*, and a rear opening 32*d* circularly opened by an inner cross section of the protrusion 32*c* is formed.

An outer diameter of the outer fitting portion 32*a* is approximately the same as an inner diameter of the wrapper 33, and the wrapper 33 is coupled to the outer fitting portion 32*a*. An inner diameter of the outer fitting portion 32*a* is approximately the same as an outer diameter of an outer end surface of the flange shaft 34, and the outer fitting portion 32*a* is coupled to the outer end surface of the flange shaft 34. An inner end surface (cylindrical portion) of the protrusion 32*c* is slightly larger than the outer diameter of the pulsator 40 and faces the outer circumferential portion of the pulsator 40 with a slight gap (distance).

An outer insertion hole 33*b* is formed in a plurality of locations at the rear end of the wrapper 33. A plurality of inner insertion holes 32*e* is also formed in the outer fitting portion 32*a* so as to overlap with each of the outer insertion holes 33*b*. In addition, a fastening hole 34*a* overlapping with the outer insertion hole 33*b* and the inner insertion hole 32*e* is formed at a plurality of locations on the outer end surface of the flange shaft 34.

For assembling the wrapper 33, the drum back 32, and the flange shaft 34, as shown in FIG. 3B, the drum back 32 is firstly fitted and fixed to the flange shaft 34 to allow the outer fitting portion 32*a* to be coupled to the outer circumferential end surface. Sequentially, the rear end of the wrapper 33 is fitted into the outer fitting portion 32*a*, and a fastening mechanism T is fastened to the outer insertion hole 33*b*, the inner insertion hole 32*e*, and the fastening hole 34*a*, which overlap with each other, outward in the radial direction. Accordingly, the wrapper 33, the drum back 32, and the flange shaft 34 are coupled to each other.

As mentioned above, the flange shaft 34 having high strength and rigidity has a large diameter approximately equal to the diameter of the wrapper 33 (that is, the drum 30), and the flange shaft 34 may be fastened to and integrated with the wrapper 33 with the drum back 32 outward in the radial direction. Therefore, the strength and rigidity of the drum 30 may be improved. In addition, even if the drum 30 is rotated and shaken in a transverse direction, the drum 30 may be stably supported.

In a case in which the drum 30 is composed of a single component, it may be possible to fix the flange shaft 34 by fastening the drum back 32 and the flange shaft 34 with screws from a front side of the wrapper 33 not from an outer circumferential side of the wrapper 33.

In a case in which the flange shaft 34 and the outer shaft 72 are not integrated by the insert molding or press-fitting, an anti-rotation structure composed of concave-convex engagement, such as a serration or a key and a key-seat may be provided on a connection portion between the flange shaft 34 and the outer shaft 72. Therefore, it is possible to prevent a rotation in a rotation direction (slide between the flange shaft 34 and the outer shaft 72). The flange shaft 34 and the outer shaft 72 are detachably coupled to each other to become an anti-rotation state and then a nut or a bolt is fastened to the flange shaft 34 and the outer shaft 72 in an axial direction, thereby preventing an axial movement.

A ball bearing or a slide bearing may be used as the inner bearing 73. The inner bearing 73 is press-fitted to one side of the outer shaft 72 and the inner shaft 71, and the inner bearing 73 is fitted to the other side of the outer shaft 72 and the inner shaft 71. One side of each end of the outer shaft 72 and the inner shaft 71 includes a step portion having a size different from an outer diameter of the main shaft portion, depending on forming a flange or mounting a snap ring. The step portion comes in contact with and is fixed to the inner bearing 73. A washer may be provided between the outer shaft 72 or the inner shaft 71 and the inner bearing 73.

The other side of each end of the outer shaft 72 and the inner shaft 71 may be fixed with a snap ring to prevent misalignment or omission during transport or assembly. Alternatively, a washer may be provided on the other side of each end of the outer shaft 72 and the inner shaft 71. A seal member is mounted at the end of the double shaft 70 on the tub 20 side to prevent water from entering the double shaft 70 or to prevent leakage to the outside of the tub 20 through the double shaft 70.

The tub 20 is composed of two or more components. The tub 20 may be configured by dividing up and down or left and right, but the most effective way may be dividing the tub 20 into two in the front and rear directions. Accordingly, in the drum type washing machine 1, the tub 20 is composed of two parts including a tub front 22 and a tub back 23 divided in front and rear as shown in FIG. 3A. A seal structure configured to prevent leakage is provided at a junction of the tub 20.

The opening 20*a* is formed at the front end of the tub front 22. The bearing housing 23*a* is installed at the rear end of the tub back 23. The tub back 23 and the bearing housing 23*a* may be formed of different materials. The tub back 23 and the bearing housing 23*a* are composed of separate components, and the bearing housing 23*a* may be fixed to the tub back 23 with bolts. In this case, a seal structure is required at a junction. Therefore, the bearing housing 23*a* and the tub back 23 may be integrally formed by the insert molding. The tub back 23 and the bearing housing 23*a* may be integrally formed of the same material, but aluminum die-casting may not be practical in terms of weight, size, and cost. Alternatively, the bearing housing 23*a* may be formed by combining a metal plate such as an iron plate or stainless steel. In this drum type washing machine 1, the bearing housing 23*a* (an aluminum die-casting material) and the tub back 23 (resin material) are integrally formed by the insert molding.

The bearing housing 23*a* includes a shaft support 24 configured to support the outer shaft 72 through the outer bearing 74. The bearing housing 23*a* may also be composed of two or more components. The outer shaft 72 is axially supported on the bearing housing 23*a* through two or more outer bearings 74 spaced apart in the axial direction. The outer bearing 74 is press-fitted into one of the outer shaft 72 and the bearing housing 23*a*, and the other side of the outer shaft 72 and the bearing housing 23*a* is gap-fitted into the outer bearing 74.

Because the front of the tub back 23 is opened, the outer shaft 72 may be inserted into the shaft support 24, which is formed in the center of the bearing housing 23*a*, from the front side of the tub back 23 even though the outer shaft 72 is integrated with the flange shaft 34. Alternatively, in a case in which the outer shaft 72 is a separate member from the flange shaft 34, the outer shaft 72 may be inserted into the shaft support portion 24 from the rear of the tub back 23.

In a case in which fitting the outer shaft 72 is fitted into the outer bearing 74, the outer shaft 72 may have the same outer diameter in the entire length direction, or an outer diameter at an insertion start side may be less than a diameter at an insertion end side. On the other hand, in a case in which the outer bearing 74, into which the outer shaft 72 is pressed, is fitted into the shaft support 24, the shaft support 24 may have an inner diameter that is equal to or greater than an inner diameter of the outer bearing 74, and an outer diameter at an insertion start side may be greater than a diameter at an insertion end side. However, a case in which the bearing housing 23*a* is composed of two or more components is not limited thereto. In addition, a size of the outer bearing 74 at the front side may be greater than the outer bearing 74 at the rear side to be stably supported by being inserted from the front side of the tub back 23.

FIG. 4 is a schematic perspective view of a pulsator of a drum type washing machine according to an embodiment of the disclosure.

Referring to FIG. 4, the pulsator 40 includes a boss portion 41 located at the center of the pulsator 40 and a disk portion 42 located around the boss portion 41, and as shown in FIG. 2, the boss portion 41 is fixed to a protruding end of the inner shaft 71. A rotation in the rotation direction between the boss portion 41 and the inner shaft 71 (slide between the boss portion 41 and the inner shaft 71) is prevented by the concave-convex engagement (anti-rotation structure), such as a serration or a key.

In terms of strength, the boss portion 41 and the disk portion 42 may be composed of two or more components having different materials. In a case in which the disk portion 42 and the boss portion 41 are formed of the same material, the strength may be relatively weak. In other words, in a case in which the pulsator 40 is formed of a metal with excellent strength, such as aluminum or stainless steel, an inertial force increases and energy loss increases as a weight of the pulsator 40 increases. In a case in which the pulsator 40 is formed of a resin, durability, such as wear or destruction may decrease. Accordingly, the boss portion 41 is formed of a strength member, such as stainless steel and has a minimum size, and the disk portion 42 may be formed of a lightweight resin. The boss portion 41 is fixed to the disk portion 42 by the press-fitting or the insert molding. A front surface of the disk portion 42 may be formed of a resin, but the front surface of the disk portion 42 may be overlaid by a thin plate, such as stainless steel for the appearance or for preventing scratches.

Alternatively, the disk portion 42 may be formed of a stainless steel plate. In a case of a resin, a thickness of the resin is required to be about 3 to 5 mm in order to secure a predetermined strength, but in the case of a stainless steel plate, the thickness of the stainless steel plate may be about 1 mm Therefore, a capacity of the drum 30 may be relatively increased.

The boss portion 41 is detachably inserted into the protruding end of the inner shaft 71 by the concave-convex engagement, and then coupled so as not to fall out by fastening using a bolt or nut. In order to prevent damage to the laundry due to the fastening portion, a protective cap 43 (protective portion) is mounted on the apex of the boss portion 41. In the gap between the pulsator 40 and the drum 30, a labyrinth structure is formed to surround the end of the pulsator 40 with a small interval to prevent the laundry from being stuck. The labyrinth structure is generally formed by the drum back 32 and the pulsator 40. Therefore, the outer diameter of the pulsator 40 may be 60% or more and less than 100% of the inner diameter of the drum 30. In response to the outer diameter of the pulsator 40 being 60% or more of the inner diameter of the drum 30, the functions of the pulsator 40, such as stirring may be appropriately performed inside the drum 30.

Particularly, the outer diameter of the pulsator 40 may be less than the inner diameter of the opening 30*a*. Accordingly, because the pulsator 40 is inserted into the drum 30 through the opening 30*a*, the pulsator 40 may be mounted on the drum 30 after assembling the drum 30, thereby simplifying manufacturing of the drum type washing machine 1. In addition, in a case in which a defect occurs in the pulsator 40 caused by long time use of user, the replacement of components of the drum type washing machine 1 may be easily performed, and the user's expense may be reduced.

On the other hand, in response to the outer diameter of the pulsator 40 being larger than the opening 30*a*, the pulsator 40 is inserted into the drum 30 from the rear. In this case, the pulsator 40 is inserted into the drum 30 before the wrapper 33 and the drum back 32 are integrated by caulking or welding, which may cause complication in the manufacturing of the drum type washing machine 1. Therefore, before the wrapper 33 and the drum back 32 are integrated, the pulsator 40 may be fixed to the inner shaft 71 through the flange shaft 34 or the wrapper 33 and the drum back 32 may be detachable by fixing screws.

In addition, by configuring the labyrinth structure with three or more components in which the flange shaft 34 is added to the drum back 32 and the pulsator 40, the pulsator 40 may be assembled after being integrated with the drum back 32 and the wrapper 33. That is, the drum back 32 constitutes a wall covering the outer side of the pulsator 40 and the flange shaft 34 constitutes a wall covering the rear side and the inner side of the pulsator 40 with other components, thereby performing the above-mentioned assembly. At this time, in order to avoid an increase in the number of components, the walls covering the rear side and the inner side of the pulsator 40 may be constituted by the flange shaft 34. The outer wall of the pulsator 40 may be composed of the flange shaft 34 instead of the drum back 32, but in this case, a gap may be generated near the inner surface of the drum 30 with which the laundry is in contact. Accordingly, the gap may cause the damage to the laundry and thus it is appropriate that the outer wall of the pulsator 40 may be composed of the drum back 32.

By providing the labyrinth structure as described above, even when the outer diameter of the flange shaft 34 is greater than the outer diameter of the pulsator 40, it is possible to prevent that the laundry is rolled up between the pulsator 40 and the drum 30, or foreign substances are introduced between the pulsator 40 and the flange shaft 34.

Detailed Structure of the Motor 50

Referring to FIG. 2, the motor 50 has a flat cylindrical appearance with a diameter less than the diameter of the tub 20, and the motor 50 is assembled to bearing housing 23*a* of the tub 20 in such a way that the rotation axis J passes through a center of the motor 50. The motor 50 is mainly composed of a stator 51, an inner rotor (first rotor) 52, an outer rotor (second rotor) 53, the inner shaft 71, and the outer shaft 72. The stator 51 is formed of an annular (ring)-shaped member having an outer diameter less than an inner diameter of the outer rotor 53 and having an inner diameter greater than an outer diameter of the inner rotor 52. The inner rotor 52 and the outer rotor 53 are connected to the pulsator 40 or the drum 30 without a clutch or acceleration/deceleration device, and the inner rotor 52 and the outer rotor 53 are configured to directly drive the pulsator 40 or the drum 30. The inner shaft 71 and the outer shaft 72 are connected to the motor 50 corresponding to the drive device.

The inner rotor 52 and the outer rotor 53 are driven by one inverter (three-phase inverter). The inner rotor 52 and the outer rotor 53 each share a coil of the stator 51 and may be independently rotated as a current is supplied to the coil. In the case of the motor 50, in response to rotating of the two rotors 52 and 53 to the same direction and to the opposite directions, a ratio of revolutions per unit time of the two rotors is a fixed value, such as 1:1, and 1:−2. Switching direction between the same direction and the opposite direction may be performed by the magnetization, and the ratio of revolutions per unit time in the same direction and the opposite direction may be different. In the drum type washing machine 1, the motor 50 may drive the outer rotor 53 and the inner rotor 52 in a plurality of rotation modes according to a control instruction of the controller 60.

The outer rotor 53 is a cylindrical member having a flat bottom, and the outer rotor 53 includes a bottom portion 121 in which a center thereof is opened, a rotor yoke 122 erected on an edge of the bottom portion 121, and a plurality of outer magnets 124 composed of an arc-shaped permanent magnet. The bottom portion 121 and the rotor yoke 122 are formed by pressing an iron plate to function as a back yoke. The inner rotor 52 is a flat cylindrical member having an outer diameter less than the outer rotor 53, and the inner rotor 52 includes an inner supporting surface portion 131 in which a center thereof is opened, an inner circumferential wall portion 132 erected on an edge of the inner supporting surface portion 131, and a plurality of inner magnets 134 composed of a rectangular plate-shaped permanent magnet. A rotor core 133 is disposed in a circumferential direction between the inner magnets 134.

The inner shaft 71 is a cylindrical shaft member, and is rotatably supported on the double shaft 70 through the inner bearing 73 and the outer shaft 72. A lower end of the inner shaft 71 is connected to the outer rotor 53. An upper end of the inner shaft 71 is connected to the pulsator 40. The outer shaft 72 is shorter than the inner shaft 71, and the outer shaft 72 is a cylindrical shaft member having an inner diameter greater than an outer diameter of the inner shaft 71. The outer shaft 72 is rotatably supported on the shaft 70 through the inner bearing 73, the inner shaft 71 and the outer bearing 74. A lower end of the outer shaft 72 is supported by the shaft support 24. An upper end of the outer shaft 72 is connected to the flange shaft 34 of the drum 30.

At this time, the motor (drive device) 50 may be configured as one of the following types or a combination thereof.

(Type 1)

In the type 1 motor 50, an inner rotor 52 and an outer rotor 53 (dual motor) are disposed inside and outside a single stator 51, respectively. The inner rotor 52 is connected to an outer shaft 72, and the outer rotor 53 is connected to an inner shaft 71. The two rotors 52 and 53 may be driven and controlled by a single inverter. The motor 50 of the drum type washing machine 1 shown in FIGS. 1 and 2 is the type 1.

(Type 2)

The motor is the same dual motor as the type 1, and the two rotors 52 and 53 may be driven and controlled by two inverters, respectively. In the case of this motor, because the rotors 52 and 53 are individually driven and controlled by respective inverters, the ratio of the revolutions per unit time may be adjusted, and thus the revolutions per unit time of each of the rotors 52 and 53 may be freely controlled.

(Type 3)

The motor is not a single stator, but an inner and outer (two layers) double stator structure in which two stators are arranged back to back. An inner rotor and an outer rotor are disposed on the inner and outer sides of the double stator structure, respectively. This motor may be functionally equivalent to two independent motors arranged side by side around the rotation axis J. In the case of this motor, the two rotors are individually driven and controlled by two inverters.

(Type 4)

Two motors may be integrated by being arranged side by side in a direction in which the rotation axis J extends. A rotor of the front motor close to a tub back 23 is connected to an outer shaft 72, and a rotor of the rear motor is connected to an inner shaft 71. The two motors are individually driven and controlled.

(Type 5)

Two common motors are used. However, unlike the direct drive type motor described above, each motor rotates the drum 30 and the pulsator 40 through a power transmission mechanism including a shaft, a pulley, and an endless belt.

(Type 6)

Like type 5, two common motors (first motor and second motor) are used. However, the second motor may be a direct-drive inner rotor motor in which a rotor rotating around the rotation axis J is placed inside a stator. A pulley rotating about the rotation axis J is provided on the outside of the stator of the second motor, and an endless belt (power transmission mechanism) is hung on the pulley. The first motor is connected to the pulley through the power transmission mechanism. A pulsator 40 is driven by the first motor through the power transmission mechanism and a drum is driven by the second motor.

In a case of mounting the above-mentioned motor 50 to the tub back 23 or the bearing housing 23*a*, the motor 50 may be directly fixed to the tub back 23 or the bearing housing 23*a* or indirectly fixed to the tub back 23 or the bearing housing 23*a* through a bracket. The motor 50 may be fixed using an elastic bush, such as rubber or resin in order to prevent a vibration, which is generated by the motor 50, from being transmitted to the tub back 23. The fixing may be performed by a bolt and a nut. Alternatively, a washer, which is configured to increase a range of an axial force, an anti-loosening spring washer, or a wave washer may be provided between the fastening devices.

Detailed Structure of the Double Shaft 70

The double shaft 70 includes the inner shaft 71 and the outer shaft 72. The double shaft 70 is mounted to the shaft support 24, which is provided in the center of the bearing housing 23*a* of the tub 20, in such a way that a center of the double shaft 70 is aligned with the rotation axis J.

The inner shaft 71 is an elongated cylindrical shaft member. The outer shaft 72 is an elongated cylindrical shaft member that is shorter than the inner shaft 71 and that has an inner diameter greater than an outer diameter of the inner shaft 71. A pair of inner bearings 73 is installed in the outer shaft 72 to be spaced vertically. A ball bearing or a slide bearing may be used as the inner bearing 73. The inner shaft 71 is inserted into the outer shaft 72, and then rotatably supported by the inner bearing 73. The inner bearing 73 is press-fitted to one of the outer shaft 72 and the inner shaft 71, and the other side of the outer shaft 72 and the inner shaft 71 is fitted to the inner bearing 73. The front end of the inner shaft 71 protrudes from the front end of the outer shaft 72, and the rear end of the inner shaft 71 protrudes from the rear end of the outer shaft 72.

Detailed Structure of the Pulsator 40

FIG. 5 is a sectional view taken along line I-I of FIG. 4 according to an embodiment of the disclosure.

Referring to FIGS. 4 to 6, on the front surface of the pulsator 40, a gently inclined surface 44 gradually inclined downward to an outer periphery from the center boss portion 41, and a plurality of protrusions 45 are provided. The gently inclined surface 44 constitutes a disk-shaped base that is spread on the front surface of the pulsator 40, and each protrusion (blade) 45 protrudes from the surface of the base portion to have a bulged shape. The gently inclined surface 44 may have few irregularities in order to reduce resistance during rotation, and is formed in a substantially flat shape. Each of the protrusions 45 extends from the boss portion 41 in the radial direction, and is radially disposed at regular intervals in the circumferential direction. In response to the protrusions 45 being disposed unevenly, the reaction force becomes non-uniform, and thus the protrusions unevenly disposed may cause abnormal vibration.

Although three protrusions 45 of the pulsator 40 are provided according to the embodiment, it is appropriate to provide two to eight protrusions 45 but it is more appropriate to provide two or three protrusions 45 so as to obtain a relatively excellent result. As the number of protrusions 45 are increased, it is difficult for the laundry to be placed between the protrusions 45, which may cause a reduction in an effect of beating the laundry and an effect of separating the laundry (washing effect) by using the protrusion 45, and a fluidity of the laundry. Therefore, the cleaning power may be deteriorated, and power consumption may also be increased.

Small protrusions smaller than the protrusions 45 may be provided at regular intervals in a portion between the protrusions 45 of the gently inclined surface 44. The effect of scrubbing the laundry may be realized by the small protrusions.

At a rated capacity of the laundry or less (for example, 60% of the capacity of the drum 30), the scrubbing effect may not be performed in a central portion of the protrusion 45 in the vicinity of the boss portion 41 because the number of contacts with the laundry is less at the rated capacity of the laundry. Accordingly, an amount of protrusion of the gently inclined surface 44 may be small at the central portion of the protrusion 45. On the other hand, in an outer circumferential side portion of the protrusion 45, as it is close to an edge, a degree of influence on the separation performance (washing performance) of the laundry is increased. Accordingly, the amount of protrusion of the gently inclined surface 44 at the outer circumferential side portion of the protrusion 45 may be greater than the amount of protrusion of the gently inclined surface 44 at the inner circumferential side portion of the protrusion 45. However, in response to the amount of protrusion of the protrusion 45 of the gently inclined surface 44 being increased, a torque required for the rotation of the pulsator 40 may also increase. In addition, in response to a reverse rotation of the drum 30 and the pulsator 40, a force of the protrusion 45 acts in a direction, which interferes with the rotation of the drum 30, through the laundry, and thus the torque required for the rotation of the drum 30 may be increased. Therefore, it is not appropriate that the amount of protrusion of the protrusion 45 at the outer circumferential side portion is too large.

A shape of the protrusion 45 is described. Each of the protrusions 45 may have a shape that protrudes from the gently inclined surface 44 and straightly extends in the radial direction from the central boss portion 41. For example, each of the protrusion 45 may have an inverted U-shaped or an inverted V-shaped cross section. In the outer circumferential side portion of each protrusion 45, a plurality of substantially flat inclined surfaces 45*a* is formed on opposite sides facing the circumferential direction.

FIG. 6 is a schematic side view of a pulsator of a drum type washing machine according to an embodiment of the disclosure.

Referring to FIG. 6, in response to an inclination angle θ of the inclined surface 45*a* being small with respect to the rotational axis J (almost parallel to the rotational axis J) when the inclined surface 45*a* is viewed in a cross-sectional direction of the protrusion 45, the laundry may collide with the inclined surface 45*a* from the front side, and thus according to the state of the laundry, the pulsator 40 may be locked and become the anti-rotation state or the pulsator 40 may be rotated with the laundry against the drive. Further, it may cause an increase in noise or abnormal vibration. Therefore, the inclination angle θ of the inclined surface 45*a* may be 15° or more. As the inclination angle θ increases, the rotational resistance of the pulsator 40 may decrease, and thus power consumption may also decrease. On the other hand, as the inclination angle θ increases, it is difficult for the laundry to be caught thereon and thus the function of beating the laundry and separating the laundry (washing function) may be reduced. Accordingly, the inclination angle θ of the inclined surface 45*a* may be 20° or less.

Particularly, by considering the balance, two inclined surfaces 45*a* having different inclination angles θ may be formed on each side of the outer circumferential portion of each protrusion 45. Particularly, a first inclined surface 45*a*1 having a relatively large inclination angle θ1 may be formed on the apex side of the protrusion 45, and a second inclined surface 45*a*2 having a relatively small inclination angle θ2 may be formed on the bottom side of the protrusion 45.

Referring to FIG. 2, the outer circumference of the pulsator 40 is disposed opposite to the inner circumferential surface of the drum 30 with a certain gap 200 and a working surface 201 configured to provide a mechanical action by being in contact with the laundry may be provided in the gap 200. Accordingly, in response to rotating the drum 30 and the pulsator 40 to opposite directions during washing, the laundry may enter the gap 200 and the laundry may be in contact with three-axis action surfaces 201 adjacent to each other (particularly, an inner circumferential surface of the drum 30 facing the gap 200, the bottom surface of the drum 30, and the outer circumferential side protruding end surface of the protrusion 45), thereby effectively applying the mechanical action to the laundry.

According to the embodiment, the pulsator 40 has a substantially conical shape, but a concave portion may be provided. In this case, the outer circumferential portion of the disk portion 42 may be located behind the boss portion 41. In response to the outer circumferential portion of the disk portion 42 protruding forward, the laundry may be pressed by the protruding portion and then the weight of the laundry may be added to the pulsator, thereby increasing the torque of the motor 50 driving the pulsator.

Washing Method

The drum type washing machine 1 synthesizes each mechanical force by opposing the rotational direction of the drum 30 to the rotational direction of the pulsator 40 (contra-rotating washing) during washing, thereby effectively applying the mechanical force to the laundry. Particularly, revolutions per unit time of the drum 30 during washing may be set to about 50 to 80 rpm to allow the laundry to stick to the inner circumferential surface of the drum 30 by centrifugal force. Further, the drum type washing machine 1 may rotate the pulsator 40 to a direction opposite to a rotation direction of the drum 30. At this time, because the laundry sticks to the inner circumferential surface of the drum 30, the protrusion 45 of the pulsator 40 collides with the laundry and beats the laundry, thereby transmitting the mechanical force of the pulsator 40 to the laundry.

In response to the rotation of the drum 30 being faster than the pulsator 40 during the contra-rotating washing, a rotation moment of the laundry becomes larger than a rotation moment of the pulsator 40, and thus the pulsator 40 may be pushed by the force of the laundry. On the other hand, in response to the rotation of the pulsator 40 being faster than the drum 30, the mechanical force of the pulsator 40 may be stably transmitted to the laundry. At this time, when it is required to reduce the mechanical force acting on the laundry, the drum type washing machine 1 may rotate the drum 30 and the pulsator 40 in opposite directions at the same revolutions per unit time, thereby reducing the action of the pulsator 40.

In the drum type washing machine 1 according to the embodiment, during washing, the following pattern may be operated in addition to the above-described contra-rotating washing.

(Pattern 1) The drum type washing machine 1 rotates the drum 30 and the pulsator 40 in the same direction at the same revolutions per unit time. The same operation as a drum type washing machine of the related art is performed.

(Pattern 2) The drum type washing machine 1 rotates the drum 30 and the pulsator 40 in the same direction, and rotates the pulsator 40 at higher revolutions per unit time than the drum 30. An operation, in which the convection effect by the pulsator 40 is applied to the operation of the pattern 1, is performed.

(Pattern 3) The drum type washing machine 1 stops energization of the motor 50 driving the pulsator 40 and rotates the drum 30 in a state in which power is not transmitted to the pulsator 40. Because all of the mechanical force required for beating-washing may be obtained from the drum 30, almost the same operation as the drum type washing machine of the related art is performed. In this operation, because the power of the pulsator 40 is cut off, power consumption may be reduced while maintaining the cleaning power.

(Pattern 4) The drum type washing machine 1 rotates the drum 30 in a state in which the rotation of the pulsator 40 is stopped. The pulsator 40 is maintained in a stationary state (the pulsator 40 is rotatable by inertia in the operation of the pattern 3). Because the pulsator 40 is stationary, the pulsator 40 is in a relatively inverted state with respect to the rotating drum 30. Therefore, there is an effect of loosening the laundry, and there is the effect of beating the laundry even it is little.

(Pattern 5) The drum type washing machine 1 rotates the pulsator 40 in a state in which power is not transmitted to the drum 30 by stopping energization of the motor 50 driving the drum 30. Contrary to the operation of pattern 3, the drum type washing machine 1 rotates the pulsator 40 in a state in which the drum 30 is rotatable by inertia. Therefore, by filling the tub 20 with sufficient water, the drum type washing machine 1 may perform "scrubbing washing" by generating a water current like a vertical washing machine. For example, in a case of sensitive clothing, the pattern 5 may reduce damage to laundry or wrinkles of laundry (Pattern 6) The drum type washing machine 1 rotates the pulsator 40 in a state in which the rotation of the drum 30 is stopped. Unlike the operation of the pattern 5 in which the drum 30 is rotatable by inertia, the drum 30 is maintained in a stationary state.

However, in order to prevent laundry from sticking to the drum in a drum type washing machine of the related art that performs "beating washing", revolutions per unit time of the drum during washing is generally set to less than 50 rpm. Therefore, the water stored in the tub is stagnant, and it is difficult for the water to continue to circulate inside the drum.

On the other hand, in the drum type washing machine 1, the revolutions per unit time of the drum 30 is set to be higher than that of a drum type washing machine of the related art, and thus the water may continue to circulate inside the drum 30 without a separate pump. That is, during washing, the drum type washing machine 1 rotates the drum 30 at a rotational speed of 50 rpm, and thus water is discharged from the gap between the tub 20 and the drum 30 and then the water flows into the inside of the drum 30. Accordingly, a sufficient mechanical force and a flow may be applied to the laundry, and thus the water may be circulated uniformly and continuously. Therefore, the drum type washing machine 1 may secure high cleaning power, and it may not cause an increase in the operating cost of the drum type washing machine 1.

In addition, the drum type washing machine 1 may stir and discharge water in a narrow gap between the tub 20 and the drum 30 by rotating the drum 30 at a rotational speed of 50 rpm or more. The discharged water is pumped up as described above and is continuously circulated inside the drum 30. Accordingly, in the drum-type washing machine 1, the discharged water may be continuously circulated even though special equipment is not installed.

Alternatively, circulating and discharging water for washing may be performed by the rotation of the pulsator 40 instead of the drum 30. In order to increase water circulation or discharge efficiency, the drum 30 or the pulsator 40 may be provided with a concave-convex structure or a stirring blade.

In addition, in the drum type washing machine 1, a protruding baffle (lifter) may be provided on the inner circumferential surface of the drum 30 in order to efficiently lift and drop laundry from a high position according to the rotation of the drum 30. Accordingly, the mechanical force caused by beating may be increased. The drum type washing machine 1 may allow the laundry to stick to the inner circumferential surface of the drum 30 by centrifugal force, and thus the amount of protrusion of the baffle may be reduced. Therefore, the member cost may be reduced, and a volume of the drum 30 may be increased.

Drive Control

During the contra-rotating washing in which the controller 60 controls the motor 50 to rotate the pulsator 40 and the drum 30 to opposite directions, the controller 60 may control a drive of the pulsator 40 based on a vertical position of imbalance caused by the laundry in the drum 30.

Figure 7:
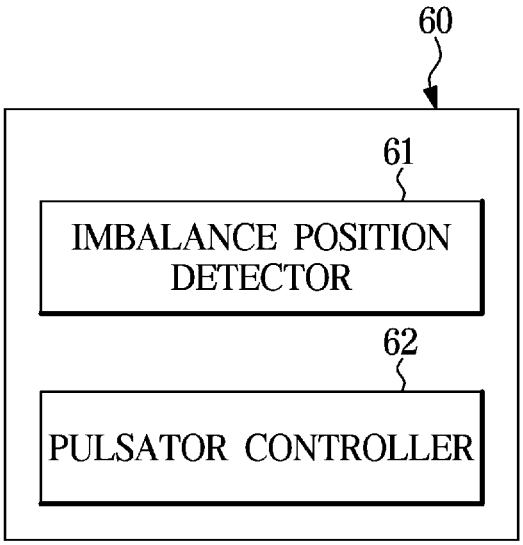
FIG. 7 is a block diagram illustrating a main portion of a control device function of a drum type washing machine according to an embodiment of the disclosure.

FIG. 7 is a block diagram illustrating a main portion of a control device function of a drum type washing machine according to an embodiment of the disclosure.

Referring to FIG. 7, the controller 60 includes an imbalance position detector 61 configured to detect a vertical position of imbalance in the drum 30, and a pulsator controller 62 configured to control a drive of the pulsator 40 based on the vertical position of imbalance detected by the imbalance position detector 61. For example, in response to detecting that an imbalance is located in a lower portion of the drum 30 by the imbalance position detector 61, the pulsator controller 62 may allow a rotational speed of the pulsator 40, a torque limit for the pulsator 40 or a speed control gain of the pulsator 40 to be smaller than that in a case of detecting that an imbalance is located in an upper portion of the drum 30.

The position of the imbalance during washing means a central position of a bundle of laundry, and when the laundry is not bundled together, the position of the imbalance means a central position of a main bundle of laundry. In addition, when the imbalance is located at the lowest point and the highest point in the drum 30 are respectively defined as 0° and 180°, at least within a range of 0°±45° may be defined as a lower portion of the drum 30, and at least within a range of 180°±45° may be defined as an upper portion of the drum 30.

In addition, in the drum type washing machine 1, the controller 60 (the imbalance position detector 61) may detect a vertical position of the imbalance in the drum 30 based on a torque current of the drum 30. For example, the imbalance position detector 61 may determine that the imbalance is located at the highest point in the drum 30 in response to a minimum torque current during one rotation cycle of the drum 30, and the imbalance position detector 61 may determine that the imbalance is located at the lowest point in the drum 30 in response to a maximum torque current during one rotation cycle of the drum 30. In addition, in response to the torque current of the drum 30 being greater than a predetermined value, the imbalance position detector 61 may determine that the imbalance is located in the lower portion of the drum 30.

The torque current of the drum 30 or the pulsator 40 means an envelope of the phase current applied to the drum 30 or the pulsator 40 (for example, one-phase current among three-phase currents), and the torque limit means an upper limit value for the torque current.

Figure 8:
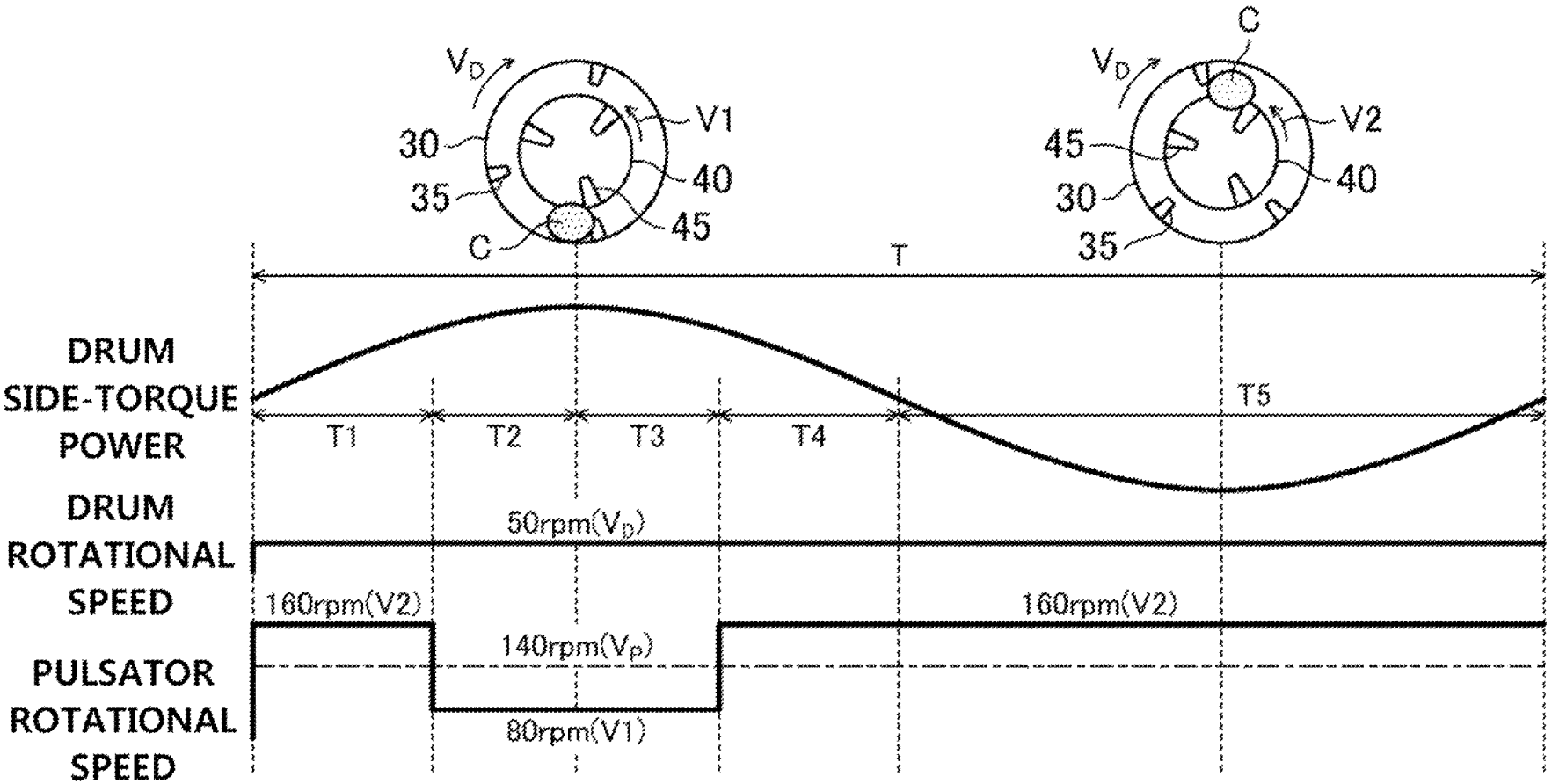
FIG. 8 is a diagram illustrating an example of drive control of a pulsator during a washing cycle of a drum type washing machine according to an embodiment of the disclosure.

FIG. 8 is a diagram illustrating an example of drive control of a pulsator during a washing cycle of a drum type washing machine according to an embodiment of the disclosure.

Referring to FIG. 8, it is a reference diagram schematically illustrating the appearance of the drum 30 and the pulsator 40 viewed from the inlet 12 of the drum type washing machine 1 for facilitating description. In this reference diagram, a positional relationship among the baffle 35 provided on the inner circumferential surface of the drum 30, the protrusions (blades) 45 of the pulsator 40, and the imbalance C is shown.

In the drive control shown in FIG. 8, the imbalance position detector 61 may detect the vertical position of the imbalance C in the drum 30 based on the torque current (q-axis current) of the drum 30. Particularly, the imbalance position detector 61 determines that the imbalance C is located at the lowest point in the drum 30 in response to the maximum torque current during one rotation cycle T (second) of the drum 30, and determines that the imbalance C is located at the highest point in the drum 30 in response to the minimum torque current during one rotation cycle T (second) of the drum 30. In addition, the imbalance position detector 61 may determine that the imbalance C is located in the lower portion of the drum 30 during a period T2 (second) before and a period T3 (second) after the maximum torque current, that is the imbalance is located on the lowest point in the drum 30. Accordingly, the pulsator controller 62 may allow a rotational speed V1 of the pulsator 40 during the corresponding period T2 and T3 to be lower than a rotational speed V2 of the pulsator 40 during other period T2, T4, and T5. For example, T may be 1.2 seconds, T1 to T5 may be 0.06 seconds, 0.24 seconds, 0.24 seconds, 0.06 seconds and 0.6 seconds, respectively, and V1 and V2 may be 80 rpm and 160 rpm, respectively. The rotational speeds of V1 and V2 may be set to allow the rotational speed VD of the drum 30 to be 50 rpm (constant), but an average rotational speed VP of the pulsator 40 to be 140 rpm.

In response to determining that the imbalance C is located in the lower portion of the drum 30 by the imbalance position detector 61, the pulsator controller 62 may reduce the rotational speed of the pulsator 40 or reduce the torque limit for the pulsator 40. For example, the pulsator controller 62 may set the torque limit to 5A in response to the imbalance C being located in the lower portion of the drum 30, and set the torque limit to 10A in response to other cases. In response to the torque current of the pulsator 40 reaching the torque limit, the pulsator controller 62 may stop supplying torque current of the pulsator 40 or stop the rotation of the pulsator 40 to lower the rotation torque of the pulsator 40 until the torque current is less than the torque limit.

In addition, in response to determining that the imbalance C is located in the lower portion of the drum 30 by the imbalance position detector 61, the pulsator controller 62 may reduce the rotational speed of the pulsator 40 or reduce the speed control gain of the pulsator 40. Accordingly, even if the rotational speed of the pulsator 40 is lower than a predetermined value, the torque current of the pulsator 40 may be not increased, and the rotation torque of the pulsator 40 may be lowered, and thus the rotation of the pulsator 40 may be stopped once.

When a capacity of the laundry is large, such as near the rated capacity in a state in which the drum 30 and the pulsator 40 are rotated in opposite directions, power consumption may be suppressed as the revolutions per unit time of the drum 30 are increased. That is, because the fluctuation, in which the laundry is deflected in the drum 30, increases in response to the low rotational speed, a high torque is required. However, because the laundry sticks to the inner circumferential surface of the drum 30 in response to the high rational speed, the deflection of the laundry may be suppressed, and the required torque may be reduced. On the other hand, when the revolutions per unit time of the drum 30 are increased too much in a state in which the capacity of laundry is small and a sufficient space is provided inside the drum 30, the centrifugal force increases and an amount of the laundry caught on the protrusion 45 of the pulsator 40 are decreased. Therefore, in this case, the drum type washing machine 1 may reduce the revolutions per unit time of the drum 30.

In order to determine a weight of the laundry put into the drum 30, a capacity of the laundry (or a remaining capacity of the drum 30), the type of the laundry (clothes type), the controller 60 may include a weight determiner, a capacity determiner, a clothes type determiner, and a drive condition determiner. The weight determiner may determine the weight of the laundry put into the drum 30. For example, the weight determiner may determine the weight of the laundry by rotating the drum 30 and the pulsator 40 in the same or opposite directions after the laundry is put into the drum 30. The revolutions per unit time may be constant or may be changed. The capacity determiner may rotate the drum 30 and the pulsator 40 again in a direction opposite to the rotation direction of the drum 30 and the pulsator 40 on the weight determination. Accordingly, the capacity determiner may determine a ratio of the laundry capacity to an inner volume of the drum 30 based on the difference from the weight detection. The clothes type determiner may supply a predetermined amount of water to the inside of the tub 20 and allow the water to be absorbed into the laundry put into the drum 30 for a predetermined time. Because the clothes type determiner stores absorption data for each type of clothes, the clothes type determiner may determine the type of laundry based on a water level change (difference between a water level at a time of supplying water and a water level after a predetermined period of time) and absorption data in the tub 20. The water level detection may be performed based on the water pressure inside the tub 20, and the water level during water supply may be calculated based on the supplied quantity. The drive condition determiner determines the rotation direction of each of the drum 30 and the pulsator 40 or the revolutions per unit time based on at least one of the determination results of the various determiners. This determination may be performed not only at the start of the washing cycle, but also during the washing cycle. Further, the determination may also be performed in the rinsing cycle.

In addition, washing process is generally divided into "washing", "rinsing", and "spinning" cycle. Between the washing cycle and the rinsing cycle, or between consecutive rinsing cycles in a case of including two or more rinsing cycles, a spinning cycle called an intermediate spinning may be provided. A torque is required to rotate the drum 30 or the pulsator 40, but a size of the required torque is different in the washing, rinsing or spinning cycle. In general, a high torque is required for the washing and rinsing cycle, and a high torque is not required for the spinning cycle. Further, in the washing or rinsing cycle, the contra-rotating washing in which the drum 30 and the pulsator 40 are rotated in opposite directions, may be performed but in the spinning cycle, the drum 30 and the pulsator 40 are rotated in the same direction. Accordingly, during the spinning, the drum type washing machine 1 may stop energization of the motor 50, which drives the pulsator 40, to allow the pulsator 40 to be rotated by inertia while rotating the drum 30. Accordingly, the power consumption for rotating the pulsator 40 is eliminated, and thus the power consumption may be suppressed. However, in this case, the drum 30 and the pulsator 40 may be rotated at different revolutions per unit time and thus a state of the laundry may be rapidly changed, thereby causing damage to the laundry.

To relieve the difficulty, a magnetization rate of the motor 50 driving the drum 30 may be changed. Accordingly, even if the drum 30 and the pulsator 40 are rotated at the same time, power consumption may be suppressed. For example, the drum type washing machine 1 may lower the magnetization rate by performing demagnetization of the motor 50 after reaching a state in which the laundry is stable (a state in which the drum 30 is rotated at a rational speed of 50 rpm~120 rpm) at the start of the spinning cycle or during the spinning cycle. Therefore, it is possible to reduce the consumption power at the high rotation.

Effect of Embodiment

The drum type washing machine 1 may control the drive of the pulsator 40 according to the vertical position of the imbalance generated by the laundry in the drum 30 during the contra-rotating washing, in which the washing is performed by rotating the drum 30 and the pulsator 40 to opposite directions. For this, in response to the imbalance being located in the lower portion of the drum 30, the drum type washing machine 1 may allow the rotational speed of the pulsator 40, the torque limit for the pulsator 40 or the speed control gain of the pulsator 40 to be smaller than that of the case in which the imbalance is located in the upper portion of the drum 30. Accordingly, the drum type washing machine 1 may reduce the frequency in which laundry is jammed between the baffle 35 of the drum 30 and the protrusions (blades) 45 of the pulsator 40. Therefore, the drum type washing machine 1 may reduce power consumption while maintaining high cleaning performance of the contra-rotating washing. Further, the drum type washing machine 1 may adjust the drive of the pulsator 40 having a low inertia instead of the drum 30 having a high inertia, thereby suppressing an increase in the power consumption. Further, in the drum type washing machine 1, the above-described jammed state may be less likely to occur, and as a result, damage to the laundry may be suppressed.

Figure 9:
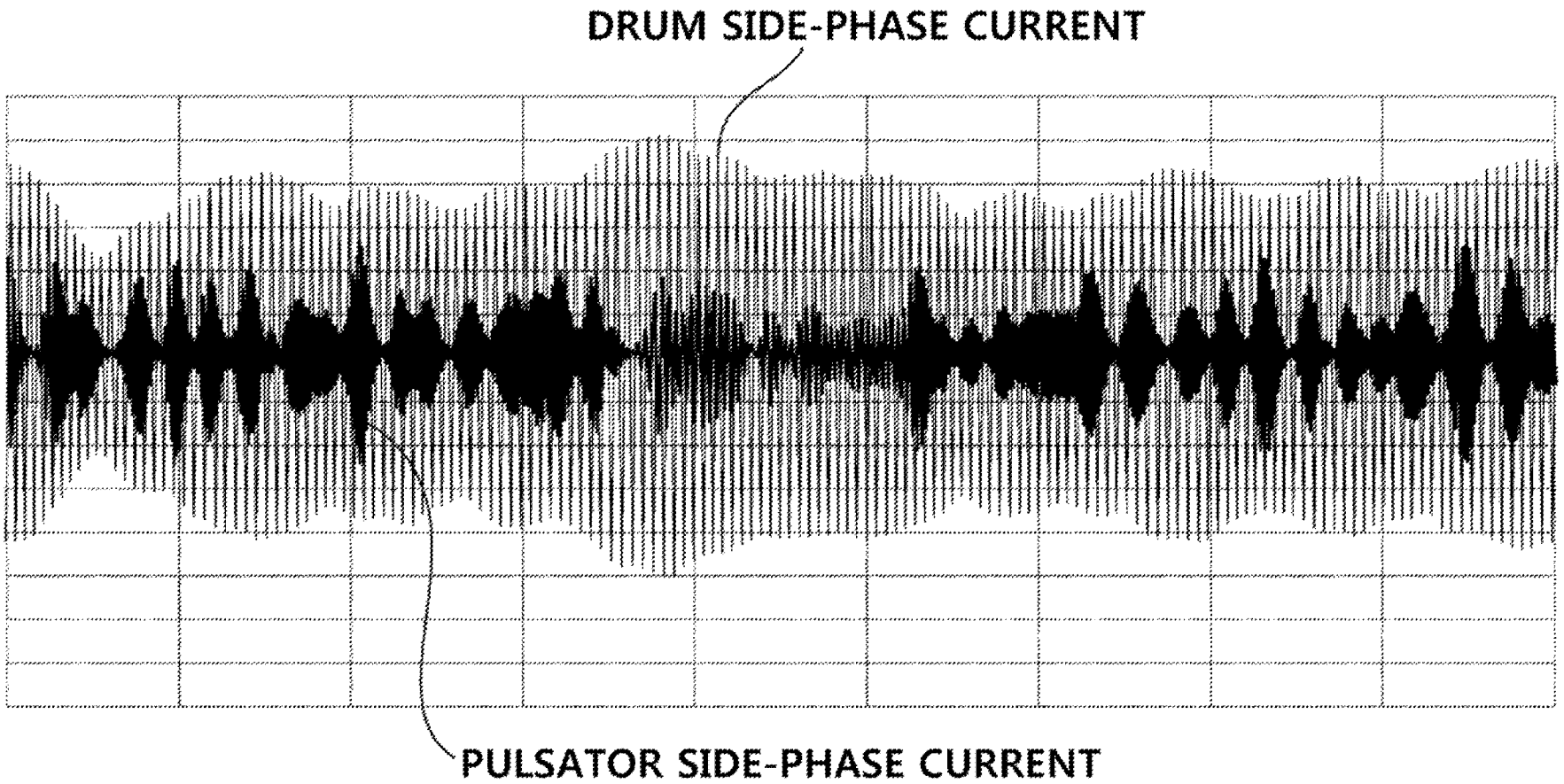
FIG. 9 is a view illustrating an example of a drum side-phase current and a pulsator side-phase current during a washing cycle of a drum type washing machine according to an embodiment of the disclosure.

FIG. 9 is a view illustrating an example of a drum side-phase current and a pulsator side-phase current during a washing cycle of a drum type washing machine according to an embodiment of the disclosure.

Figure 10:
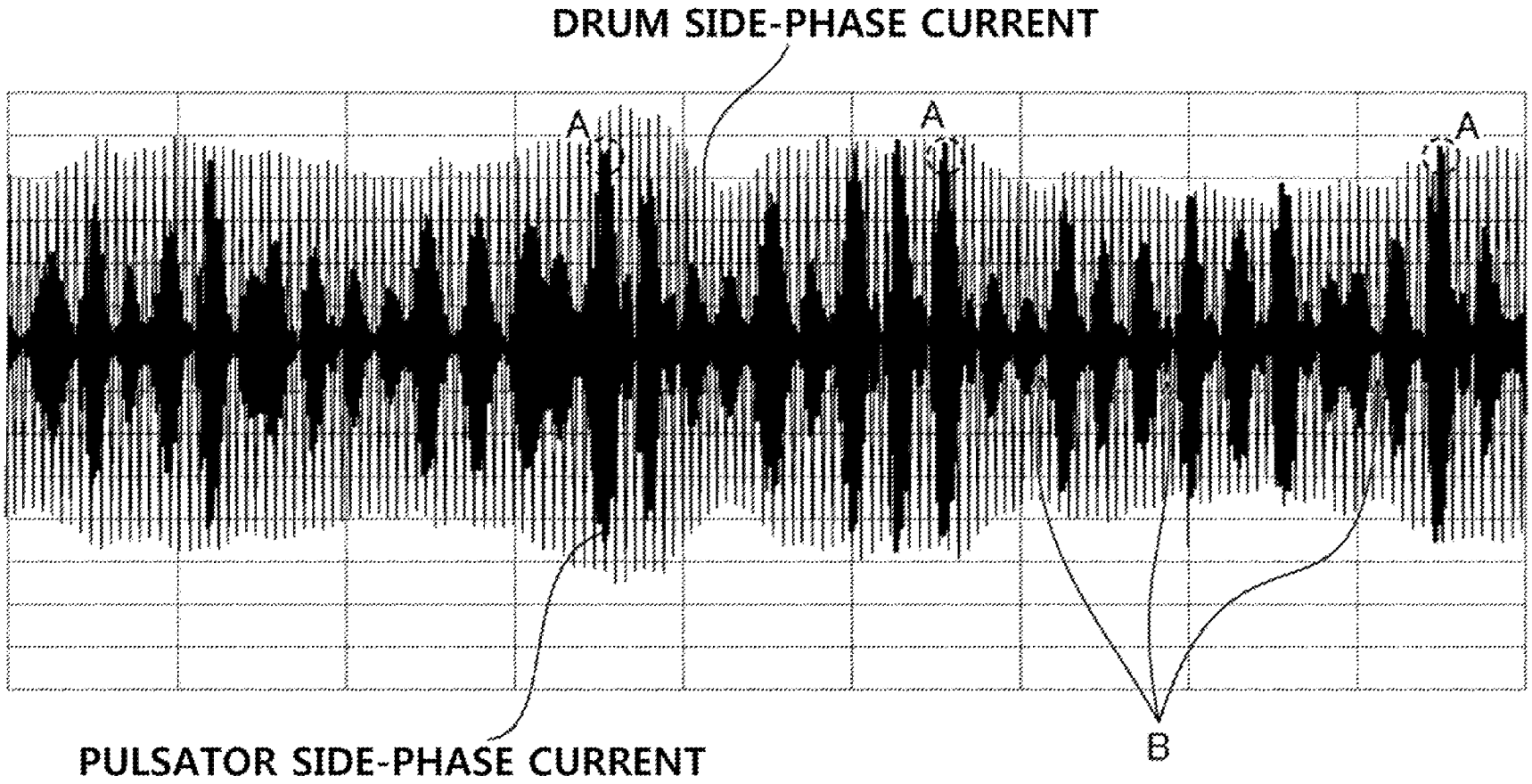
FIG. 10 is a view illustrating an example of a drum side-phase current and a pulsator side-phase current during a washing cycle of a drum type washing machine according to a comparative example according to an embodiment of the disclosure.

FIG. 10 is a view illustrating an example of a drum side-phase current and a pulsator side-phase current during a washing cycle in which a drive adjustment of a pulsator, which is according to a vertical position of an imbalance in a drum, is not performed (comparative example) according to an embodiment of the disclosure.

Referring to FIGS. 9 and 10, a phase current shown in FIG. 9 is a case in which the drive control shown in FIG. 8 is performed, and a phase current shown in FIG. 10 is a case in which the rotational speed VP of the pulsator 40 is changed to a constant 140 rpm from the drive control shown in FIG. 8.

In the drum type washing machine 1 according to the embodiment, by performing the drive adjustment of the pulsator 40 according to the vertical position of the imbalance in the drum 30, a torque current (upper envelope of the phase current) of the pulsator 40 shown in FIG. 9 that is the power consumption is clearly reduced in comparison with the comparative example shown in FIG. 10.

Figure 11A:
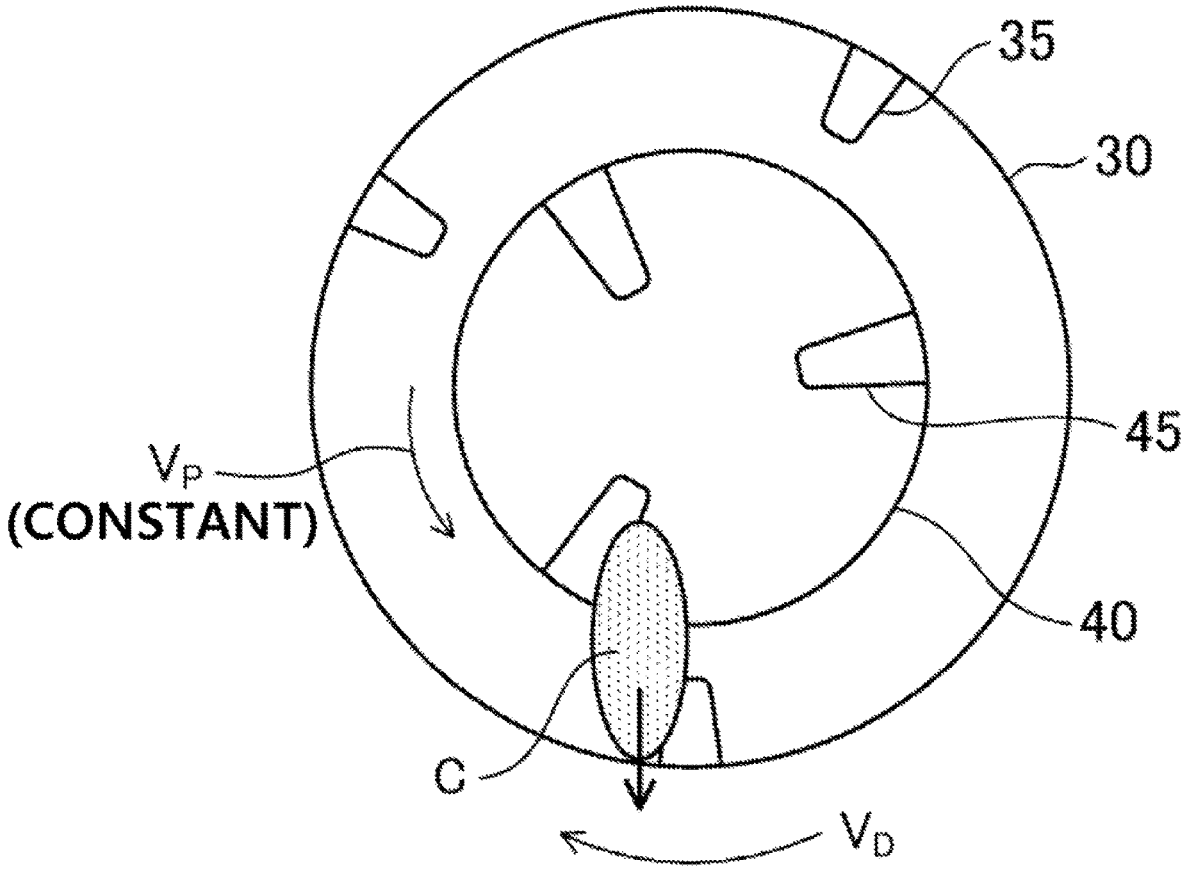
FIG. 11A is a view illustrating a state in which an imbalance is placed in a lower portion of a drum during a washing cycle of a drum type washing machine according to the comparative example according to an embodiment of the disclosure.

In addition, as for the comparative example shown in FIG. 10, in a region A in which the torque current of the pulsator 40 is maximized, the imbalance C is located in the lower portion of the drum 30, as shown in FIG. 11A, and thus the laundry may be easily bundled by gravity, thereby causing the jammed state.

FIG. 11A is a view illustrating a state in which an imbalance is placed in a lower portion of a drum during washing of a drum type washing machine according to a comparative example according to an embodiment of the disclosure.

Figure 11B:
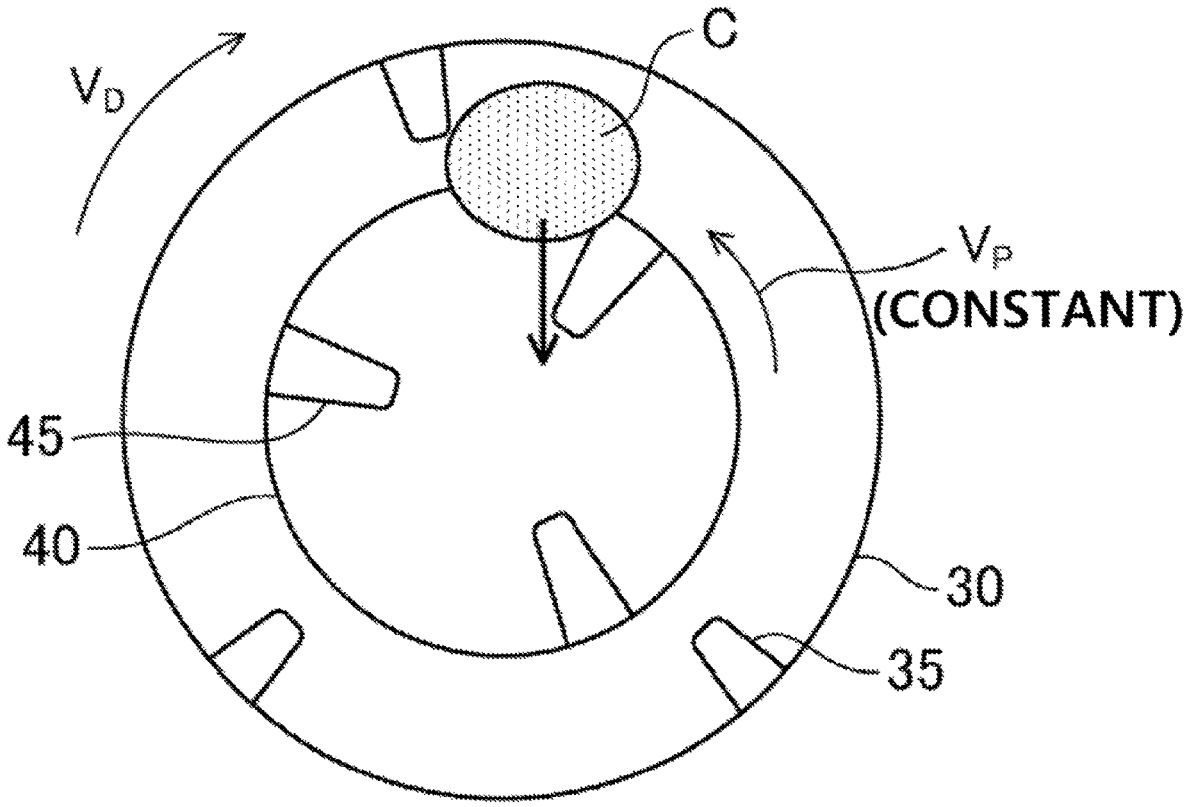
FIG. 11B is a view illustrating a state in which an imbalance is placed in an upper portion of a drum during a washing cycle of a drum type washing machine according to the comparative example according to an embodiment of the disclosure.

Referring to FIG. 11A, as for the comparative example, in a region B in which the torque current of the pulsator 40 is minimized, the imbalance C is located in the upper portion of the drum 30, as shown in FIG. 11B, and thus the laundry may easily fall by gravity, thereby preventing the jammed state.

FIG. 11B is a view illustrating a state in which an imbalance is placed in an upper portion of a drum during washing of a drum type washing machine according to a comparative example according to an embodiment of the disclosure.

Referring to FIG. 11A, in the drum type washing machine 1 according to the embodiment, the controller 60 (the imbalance position detector 61) may easily detect the vertical position of the imbalance in the drum 30 by detecting the vertical position of the imbalance in the drum 30 based on the torque current of the drum 30. For example, the imbalance position detector 61 may determine that the imbalance is located at the highest point in the drum 30 in response to the minimum torque current during one rotation cycle of the drum 30, the imbalance position detector 61 may determine that the imbalance is located at the lowest point in the drum 30 in response to the maximum torque current during one rotation cycle of the drum 30, or the imbalance position detector 61 may determine that the imbalance is located in the lower portion of the drum 30 in response to the torque current being greater than a predetermined value.

The drum type washing machine 1 according to the embodiment may allow the rotational speed of the pulsator 40 to be greater than the rotational speed of the drum 30, thereby performing "washing" by using the centrifugal force of the drum 30 and the mechanical force of the pulsator 40. Accordingly, the drum type washing machine 1 may comprehensively obtain the effect of beating the laundry with the protrusion 45 of the pulsator 40, the effect of scrubbing the laundry, and the effect of reducing of bundling the laundry caused by mixing the laundry.

The configuration of the drum type washing machine is basically the same as the configuration of the drum type washing machine 1 of the above embodiment shown in FIGS. 1 to 6, except for control contents by a controller (control device) 60 to be described later.

However, during the contra-rotating washing, the speed control gain of the pulsator may be set to be high to avoid step-out caused by suddenly applying a high load to the pulsator. The speed control gain of the pulsator represents a control parameter configured to adjust followability about a target speed upon controlling revolutions per unit time of a drive motor of the pulsator to match a rotational speed (revolutions per unit time) of the pulsator with the target speed (target revolutions).

Figure 12:
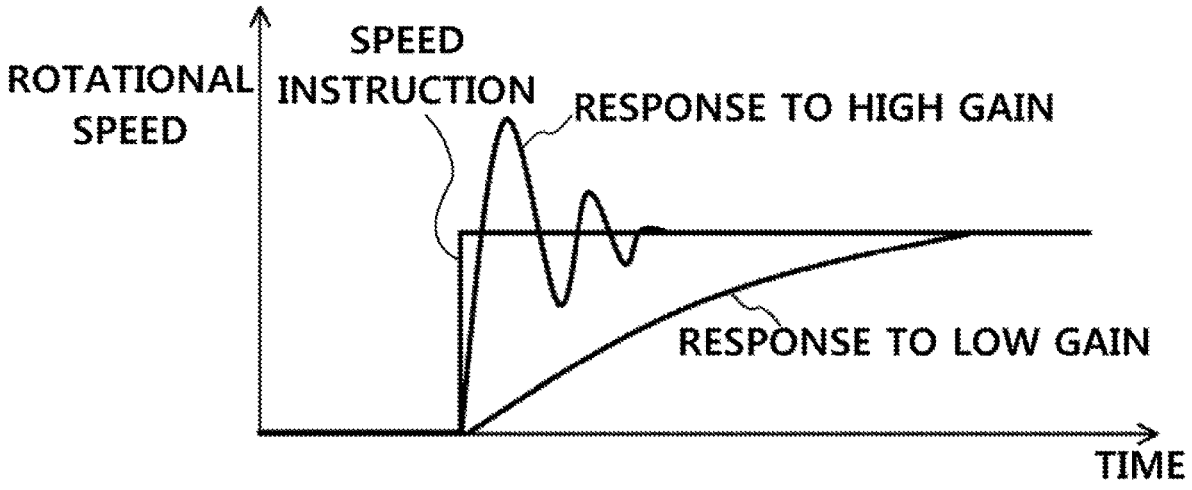
FIG. 12 is a graph illustrating a relationship between a magnitude of a speed control gain of the pulsator, and time variation of a rotational speed of the pulsator according to an embodiment of the disclosure.

FIG. 12 is a graph illustrating a relationship between a magnitude of a speed control gain of the pulsator, and time variation of a rotational speed of the pulsator according to an embodiment of the disclosure.

Referring to FIG. 12, in response to the high speed control gain, the responsiveness is fast, but overshoot occurs or the response becomes vibrating. Therefore, the followability for sudden load fluctuations may be ensured, but because it reacts sensitively to slight load fluctuations, unnecessary operations for the pulsator may increase, and power consumption may increase.

On the other hand, as shown in FIG. 12, in response to the low speed control gain, the responsiveness is slow, but smooth following of the target speed is possible. In other words, in response to the low speed control gain, it is easy step-out due to poor followability to sudden load fluctuations, but power consumption may be reduced due to suppression of unnecessary operations in the pulsator.

As mentioned above, when the speed control gain of the pulsator is set to be high to avoid step-out caused by the high load of the pulsator during the contra-rotating washing, the power consumption of the pulsator may increase due to unnecessary operation caused by too high speed control gain because a load applied to the pulsator is relatively low at a normal drive having the small imbalance.

Therefore, in the drive control of the drum type washing machine 1, the controller 60 may adjust the drive of the pulsator 40 according to the amount of imbalance generated by the laundry in the drum 30 during the controller 60 controls the motor 50 to perform the contra-rotating washing in which the drum 30 and the pulsator 40 are rotated in opposite directions.

Figure 13:
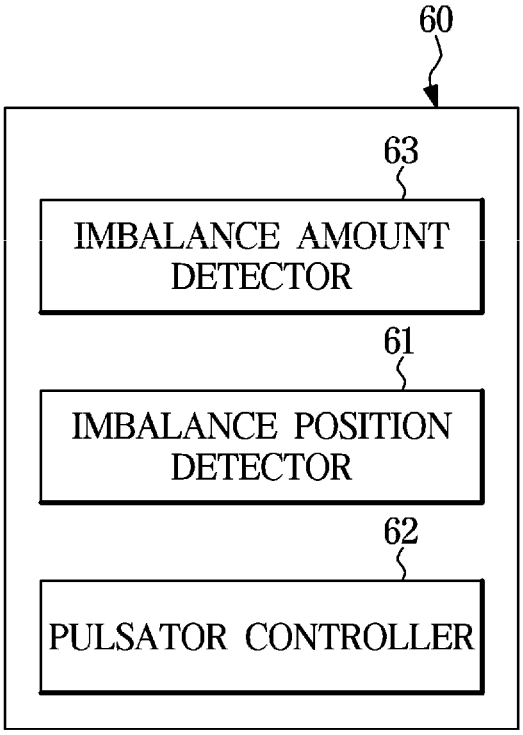
FIG. 13 is a block diagram illustrating a main portion of a control device function of a drum type washing machine according to a modified example according to an embodiment of the disclosure.

FIG. 13 is a block diagram illustrating a main portion of a control device function of a drum type washing machine according to a modified example according to an embodiment of the disclosure.

Referring to FIG. 13, the controller 60 includes an imbalance amount detector 63 configured to detect the amount of imbalance in the drum 30, an imbalance position detector 61 configured to detect the vertical position of imbalance in the drum 30, and a pulsator controller 62 configured to control the drive of the pulsator 40 based on the vertical position of imbalance detected by the imbalance position detector 61 and the amount of imbalance in the drum 30 detected by the imbalance amount detector 63.

The amount of imbalance during washing means a degree of bundle of laundry in the drum 30. The amount of imbalance is relatively large when the laundry is bundled together in the drum 30, and the amount of imbalance is relatively small when the laundry is relatively scattered in the drum 30. In addition, in response to the amount of imbalance in the drum 30 being increased, amplitude of the torque current of the drum 30 may increase. Conversely, in response to the amount of imbalance in the drum 30 being reduced, amplitude of the torque current of the drum 30 may decrease. Therefore, the amount of imbalance may be quantified based on the amplitude of the torque current of the drum 30.

Figure 14:
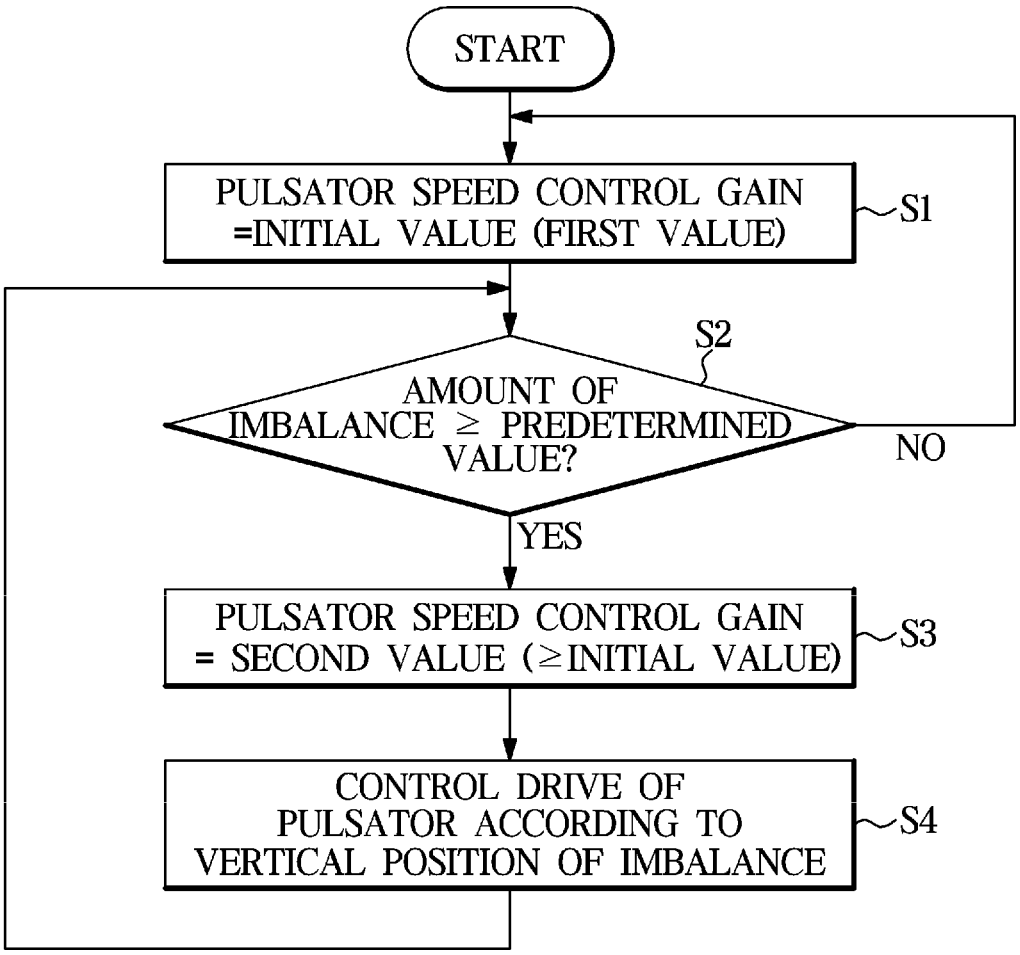
FIG. 14 is a flowchart illustrating an example of drive control of a pulsator during a washing cycle of a drum type washing machine according to the modified example according to an embodiment of the disclosure.

FIG. 14 is a flowchart illustrating an example of drive control of the pulsator 40 by the controller 60 during the contra-rotating washing according to the modified example according to the embodiment of the disclosure.

Referring to FIG. 14, when the contra-rotating washing is started, the pulsator controller 62 sets the speed control gain of the pulsator 40 to an initial value (first gain value), in operation S1.

Subsequently, the imbalance amount detector 63 detects an amount of imbalance in the drum 30, and the pulsator controller 62 determines whether the detected amount of imbalance is equal to or greater than a predetermined value in operation S2. The imbalance amount detector 63 may detect the amount of imbalance in the drum 30 based on the amplitude of the torque current of the drum 30. Particularly, as an index of the imbalance amount, the imbalance amount detector 63 may measure the amplitude of the torque current during one rotation cycle of the drum 30, for each cycle, and the pulsator controller 62 may determine whether the detected imbalance amount is equal to or greater than a predetermined value. The predetermined value of the imbalance amount may be arbitrarily set according to target power consumption, washing time, amount or type of laundry.

In response to determining that the amount of imbalance is less than the predetermined value in operation S2, the pulsator controller 62 returns to operation S1 and continues to maintain the speed control gain of the pulsator 40 to maintain the first gain value. In response to determining that the amount of imbalance is equal to or greater than the predetermined value, in operation S2, the pulsator controller 62 sets the speed control gain of the pulsator 40 to a second gain value greater than the first gain value in operation S3. Accordingly, it is possible to improve the followability of the target value of the rotational speed of the pulsator 40 for load fluctuations due to imbalance.

In addition, in response to determining that the amount of imbalance is equal to or greater than the predetermined value, in operation S2, the pulsator controller 62 performs the drive adjustment of the pulsator 40 according to the vertical position of the imbalance in operation S4. For example, in response to detecting the imbalance being located in the lower portion of the drum 30 by the imbalance position detector 61, the pulsator controller 62 may allow the rotational speed of the pulsator 40, the torque limit for the pulsator 40 or the speed control gain of the pulsator 40 to be smaller than that of the case in which the imbalance is located in the upper portion of the drum 30.

Subsequently, the pulsator controller 62 returns to operation S2 and repeatedly performs the drive control of the pulsator 40. That is, in response to determining that the amount of imbalance is less than the predetermined value, the pulsator controller 62 returns to operation 51 and sets the speed control gain of the pulsator 40 as the first gain value. In response to determining that the amount of imbalance is equal to or greater than the predetermined value, the pulsator controller 62 sets the speed control gain of the pulsator 40 to a second gain value greater than the first gain value in operation S3.

Figure 15A:
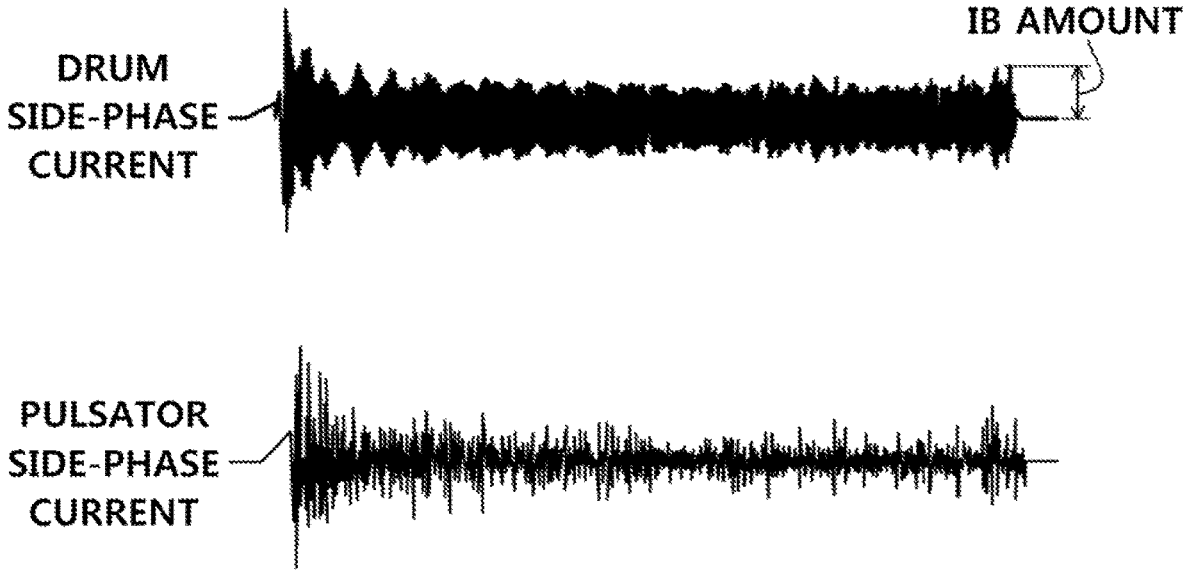
FIG. 15A is a view illustrating an example of a drum side-phase current and a pulsator side-phase current in response to a small amount of imbalance during a washing cycle of a drum type washing machine according to the modified example according to an embodiment of the disclosure.
Figure 15B:
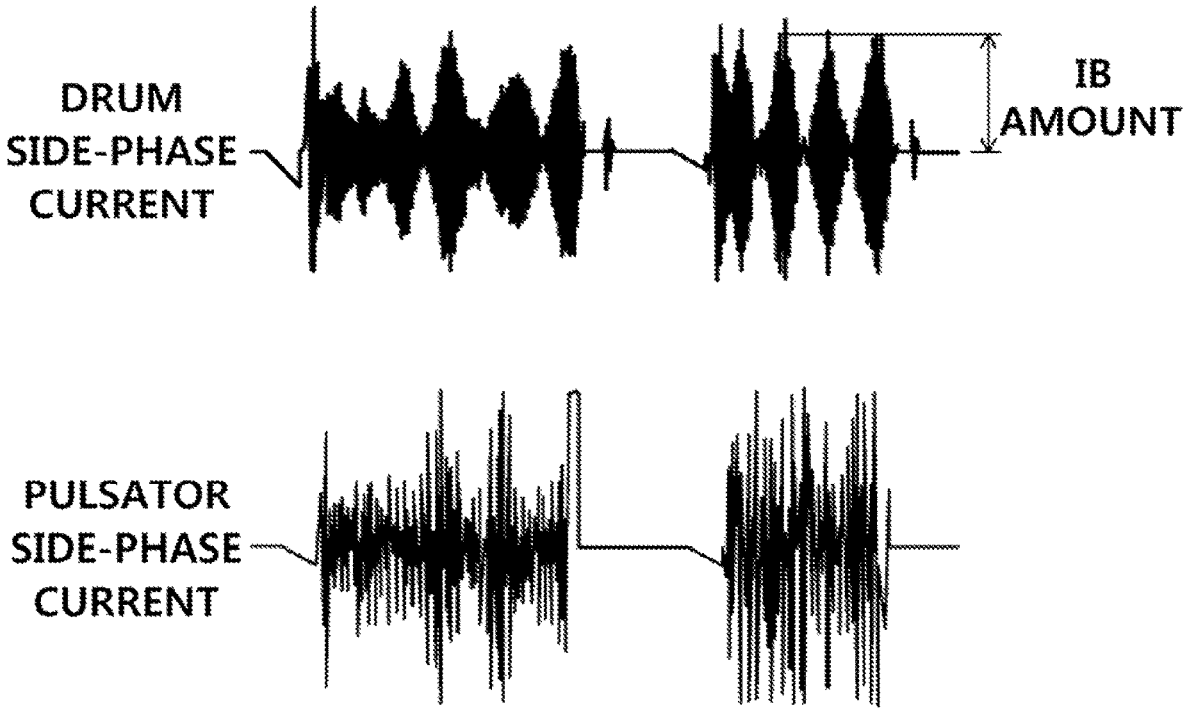
FIG. 15B is a view illustrating an example of a drum side-phase current and a pulsator side-phase current in response to a large amount of imbalance during a washing cycle of a drum type washing machine according to the modified example according to an embodiment of the disclosure.

FIGS. 15A and 15B are views illustrating an example of a drum side-phase current and a pulsator side-phase current in response to a small amount of imbalance and a large amount of imbalance during washing of the drum type washing machine 1 according to the modified example according to various embodiments of the disclosure. At this time, FIGS. 15A and 15B each show a phase current on the drum side and a phase current on the pulsator side during one rotation of the drum 30.

Referring to FIGS. 15A and 15B, in response to a relatively small amount of imbalance in the drum 30, an amount of amplitude (UB amount) of the torque current (upper envelope of the phase current) of the drum 30 may be relatively reduced, and in response to a relatively large amount of imbalance in the drum 30, the amount of amplitude of the torque current of the drum 30 may be relatively increased.

Referring to FIG. 15A, in response to a relatively small amount of imbalance (the imbalance is less than a predetermined value, the drum type washing machine 1 sets the speed control gain of the pulsator 40 to a relatively small first gain value. Therefore, because overshoot or vibrating response at the rotational speed of the pulsator 40 is suppressed, the amplitude of the torque current (the upper envelope of the phase current) of the pulsator 40 is also relatively small, as shown in FIG. 15A.

Referring to FIG. 15B, on the other hand, in response to a relatively large amount of imbalance (the imbalance is equal to or greater than the predetermined value), the drum type washing machine 1 sets the speed control gain of the pulsator 40 to a relatively large second gain value. Therefore, because overshoot or vibrating response at the rotational speed of the pulsator 40 easily occurs, the amplitude of the torque current (the upper envelope of the phase current) of the pulsator 40 is also relatively large, as shown in FIG. 15B.

As mentioned above, the controller 60 may adjust the drive of the pulsator 40 according to the amount of imbalance generated by the laundry in the drum 30 during the contra-rotating washing in which the washing is performed by rotating the drum 30 and the pulsator 40 to opposite directions. Therefore, for example, as for the speed control gain of the pulsator 40, the drum type washing machine 1 sets a small gain value (the first gain value) in response to the amount of the imbalance being less than the predetermined value, and the drum type washing machine 1 sets a large gain value (the second gain value) in response to the amount of the imbalance being equal to or greater than the predetermined value. Accordingly, when the load applied to the pulsator 40 is relatively low due to the small imbalance, the drum type washing machine 1 may prevent the unnecessary operation of the pulsator 40 caused by too high speed control gain. Therefore, the drum type washing machine 1 may reduce power consumption while maintaining high cleaning performance of the contra-rotating washing.

In addition, in response to the amount of the imbalance being equal to or greater than the predetermined value, the drum type washing machine 1 adjusts the drive of the pulsator 40 according to the vertical position of the imbalance through the controller 60 as in the above embodiment. Accordingly, the drum type washing machine 1 reduces the frequency in which laundry is jammed between the baffle and the blade of the pulsator 40, thereby further reducing the power consumption.

In addition, because the controller 60 detects the amount of imbalance in the drum 30 based on the amplitude of the torque current of the drum 30, the drum type washing machine 1 may easily detect the amount of imbalance in the drum 30.

In response to determining that the amount of the imbalance is equal to or greater than the predetermined value, in operation S2, the drum type washing machine 1 performs the drive adjustment of the pulsator 40 according to the vertical position of the imbalance in operation S4. However, for example, when the rotational speed of the pulsator 40 is allowed to be small to avoid locking of the pulsator 40 caused by the larger amount of the laundry, which is washed in the contra-rotating washing, than the rated capacity, the drum type washing machine 1 may perform only the adjustment of the speed control gain according to the amount of imbalance, but may not perform the adjustment of the rotational speed of the pulsator 40 according to the vertical position of the imbalance. Alternatively, even when it is difficult for laundry to be jammed between the baffles of the drum 30 and the blades of the pulsator 40 because the amount of laundry washed in the contra-rotating washing is small, the drum type washing machine 1 may perform only the adjustment of the speed control gain according to the amount of imbalance, but may not perform the adjustment of the drive control of the pulsator 40 according to the vertical position of the imbalance. In this case, the controller 60 (refer to FIG. 13) may be not provided with the imbalance position detector 61 and the pulsator controller 62 may perform the drive control of the pulsator 40 based on only the amount of the imbalance detected by the imbalance amount detector 63.

As mentioned above, the drum type washing machine 1 may adjust the drive of the pulsator 40 according to a state of imbalance generated by the laundry in the drum 30 during the contra-rotating washing in which the washing is performed by rotating the drum 30 and the pulsator 40 to opposite directions. Therefore, by adjusting the rotational speed of the pulsator 40, the torque limit for the pulsator 40, and the speed control gain of the pulsator 40 according to the vertical position of the imbalance or the amount of imbalance, the drum type washing machine 1 suppresses the case in which the laundry is jammed between the baffle of the drum 30 and the blades of the pulsator 40 or the unnecessary operation of the pulsator 40 caused by too high speed control gain. Accordingly, the drum type washing machine 1 may reduce the power consumption while maintaining the high cleaning performance of the contra-rotating washing. In addition, the drum type washing machine 1 adjusts the drive of the pulsator 40 having a low inertia instead of the drum 30 having a high inertia, thereby suppressing an increase in the power consumption.

In the above embodiment, the rotation axis of the drum 30 is extended in a substantially horizontal direction, but is not limited thereto (a state with the opening of the drum 30 upward). Therefore, the disclosure may be applicable to a case in which the rotation axis of the drum 30 is inclined with respect to the vertical direction. Particularly, when the rotation axis of the drum 30 is inclined by 45° or more with respect to the vertical direction, the effects of the disclosure may be remarkably performed.

In addition, in the above embodiment, the drum type washing machine 1 detects the vertical position or amount of the imbalance in the drum 30 based on the torque current of the drum 30. Alternatively, the drum type washing machine 1 detects the vertical position of the imbalance in the drum 30 by using a position detection sensor. Further, the drum type washing machine 1 detects the vertical position or amount of the imbalance in the drum 30 by mounting a vibration sensor or speed (rotational speed) sensor to the drum 30. In this case, in response to the bundle of laundry falling from the upper portion to the lower portion in the drum 30, a value measured by the vibration sensor becomes the maximum, and a value measured by the speed sensor becomes the minimum. Therefore, the drum type washing machine 1 may detect the vertical position of the imbalance from the change in the sensor measurement value, and detect the amount of the imbalance based on the maximum value or the minimum value of the sensor measurement value.

In addition, in the above embodiment, the drum type washing machine 1 adjusts the drive of the pulsator 40 based on the vertical position or amount of the imbalance, as the imbalance state. However, instead of or in addition to this, the drum type washing machine 1 may adjust the drive of the pulsator 40 based on other state of imbalance, such as a vertical speed of imbalance or a rate of change of the amount of imbalance.

As described above, the cause of the increase in power consumption during the contra-rotating washing by a drum type washing machine of the related art is as follows. During the contra-rotating washing, the laundry rotated by the baffle of the drum may be jammed in the protrusion (blade) of the pulsator, thereby increasing the current consumption of the pulsator. In addition, when the imbalance generated by the laundry is located in the upper portion of the drum, the above-described jammed state is difficult to occur because the laundry is likely to fall by gravity, but when the imbalance is located in the lower portion of the drum, the laundry is likely to bundle by gravity and thus the above-described jammed state is likely to occur. Further, the speed control gain of the pulsator is set to be high to avoid the step-out caused by the high load that is suddenly applied to the pulsator during the contra-rotating washing. However, in the normal drive, in which the amount of imbalance is small, a load applied to the pulsator may be relatively low, and thus the power consumption of the pulsator may be increased due to unnecessary operation caused by too high speed control gain of the pulsator.

According to the disclosure, the drum type washing machine includes the housing including the inlet through which laundry enters, the tub installed inside the housing, the drum rotatably accommodated in the tub in a state of being opened toward the inlet, the pulsator configured to be rotatable at the bottom of the drum, the drive device configured to drive the drum and the pulsator, and the control device configured to control the drive device. The rotation axis of the drum is inclined with respect to the vertical direction. The control device rotates the pulsator and the drum to the different directions by controlling the drive device during washing, and at the same time, the control device adjusts a drive of the pulsator according to a state of imbalance generated by laundry in the drum.

According to the disclosure, the drum type washing machine adjusts the drive of the according to a state of imbalance generated by the laundry in the drum during the contra-rotating washing in which the washing is performed by rotating the drum and the pulsator to opposite directions. Therefore, by adjusting the rotational speed of the pulsator, the torque limit for the pulsator, and the speed control gain of the pulsator according to the vertical position of the imbalance or the amount of imbalance, the drum type washing machine suppresses the case in which the laundry is jammed between the baffle of the drum and the blades of the pulsator or unnecessary operation of the pulsator caused by too high speed control gain. Accordingly, the drum type washing machine may reduce the power consumption while maintaining the high cleaning performance of the contra-rotating washing. In addition, the drum type washing machine adjusts the drive of the pulsator having a low inertia instead of the drum having a high inertia, thereby suppressing an increase in the power consumption.

In the drum type washing machine according to the embodiment, the state of imbalance may be the vertical position of the imbalance. That is, the drum type washing machine may adjust the drive of the pulsator according to the vertical position of the imbalance generated by the laundry in the drum during the contra-rotating washing in which the washing is performed by rotating the drum and the pulsator to opposite directions. Accordingly, in response to the imbalance being located in the lower portion of the drum, the drum type washing machine may allow the rotational speed of the pulsator, the torque limit for the pulsator or the speed control gain of the pulsator to be smaller than that of the case in which the imbalance is located in the upper portion of the drum. Accordingly, the drum-type washing machine may reduce the frequency in which laundry is jammed between the baffle of the drum and the blade of the pulsator. Therefore, the drum type washing machine may reduce the power consumption while maintaining the high cleaning performance of the contra-rotating washing. In addition, the above-described jammed state is less likely to occur, and as a result, damage to the laundry may be suppressed.

The position of the imbalance during washing means a central position of a bundle of laundry, and when the laundry is not bundled together, the position of the imbalance means a central position of a main bundle of laundry. In addition, when the imbalance is located at the lowest point and the highest point in the drum 30 are respectively defined as 0° and 180°, at least within a range of 0°±45° may be defined as a lower portion of the drum, and at least within a range of 180°±45° may be defined as an upper portion of the drum.

In addition, in the drum type washing machine according the embodiment, the control device may detect a vertical position of the imbalance in the drum based on a torque current of the drum. Therefore, the control device may easily detect the vertical position of the imbalance in the drum. For example, the control device may determine that the imbalance is located at the highest point in the drum in response to a minimum torque current during one rotation cycle of the drum, and the control device may determine that the imbalance is located at the lowest point in the drum in response to a maximum torque current during one rotation cycle of the drum. In addition, in response to the torque current of the drum being greater than a predetermined value, the control device may determine that the imbalance is located in the lower portion of the drum.

The torque current of the drum or the pulsator means an upper envelope of phase current applied to the drum or the pulsator, and the torque limit means an upper limit value for the torque current.

In the drum type washing machine according to the embodiment, the state of imbalance may be the amount of imbalance. That is, the drum type washing machine may adjust the drive of the pulsator according to the amount of imbalance generated by the laundry in the drum during the contra-rotating washing in which the washing is performed by rotating the drum and the pulsator to opposite directions. For example, as for the speed control gain of the pulsator, the drum type washing machine sets a small gain value in response to the amount of the imbalance being less than the predetermined value, and the drum type washing machine sets a large gain value in response to the amount of the imbalance being equal to or greater than the predetermined value. Accordingly, when the load applied to the pulsator is relatively low due to the small imbalance, the drum type washing machine may prevent the unnecessary operation of the pulsator caused by too high speed control gain. Therefore, the drum type washing machine may reduce the power consumption while maintaining the high cleaning performance of the contra-rotating washing.

In addition, in response to the amount of the imbalance being equal to or greater than the predetermined value, the drum type washing machine may set the large gain value and then adjust the drive of the pulsator according to the vertical position of the imbalance. Accordingly, the drum type washing machine may reduce the frequency in which laundry is jammed between the baffle and the blade of the pulsator, thereby further reducing the power consumption.

In the disclosure, the amount of imbalance during washing means a degree of bundle of laundry in the drum. The amount of imbalance is relatively large when the laundry is bundled together in the drum, and the amount of imbalance is relatively small when the laundry is relatively scattered in the drum. In addition, in response to the amount of imbalance in the drum being increased, amplitude of the torque current of the drum may increase. Conversely, in response to the amount of imbalance in the drum being reduced, amplitude of the torque current of the drum may decrease. Therefore, the amount of imbalance may be quantified based on the amplitude of the torque current of the drum.

That is, in the drum type washing machine according to the embodiment, the control device may detect the amount of imbalance in the drum based on the amplitude of the torque current of the drum. Accordingly, the control device may easily detect the amount of imbalance in the drum.

In addition, in the drum-type washing machine according to the embodiment, in response to the rotation axis of the drum being inclined by 45° or more with respect to the vertical direction, the effects of the disclosure may be remarkably obtained.

As is apparent from the above description, the drum-type washing machine may reduce the power consumption while maintaining the high cleaning performance of the contra-rotating washing.

Although a few embodiments of the disclosure have been shown and described, it would be appreciated by those skilled in the art that changes may be made in these embodiments without departing from the principles and spirit of the disclosure, the scope of which is defined in the claims and their equivalents.

Various embodiments of the disclosure have been described above. In the various embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described embodiments, various embodiments can thus be implemented through computer readable code/instructions in/on a medium, e.g., a computer readable medium, to control at least one processing element to implement any above described embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While the disclosure has been shown and described with reference to various embodiments thereof, it will be understood by those skilled in the art that various changes in form and details may be made therein without departing from the spirit and the scope the disclosure as defined by the appended claims and their equivalents.

What is claimed is:

1. A washing apparatus comprising:

a tub;

a drum configured to be rotatable in the tub;

a pulsator configured to be rotatable at various speeds in the drum;

a driver configured to drive at least one of the drum and the pulsator; and a controller configured to control the driver to rotate the pulsator to a second direction while rotating the drum to a first direction, wherein the controller is further configured to control the driver to drive the pulsator at a rotational speed based on a vertical position of laundry accommodated in the drum while rotating the drum, and wherein the controller is further configured to control the driver to:

rotate the pulsator at a first rotational speed based on laundry being located at a low point of the drum while rotating the drum, and rotate the pulsator at a second rotational speed, which is higher than the first rotational speed, based on the laundry being located at a high point of the drum while rotating the drum.

2. The washing apparatus of claim 1, wherein the controller is further configured to control the driver to:

rotate the pulsator at the first rotational speed based on that the laundry is located under a first reference position while rotating the drum, and rotate the pulsator at the second rotational speed, which is higher than the first rotational speed, based on that the laundry is located above a second reference position, which is higher than the first reference position, while rotating the drum.

3. The washing apparatus of claim 1, wherein the controller is further configured to control the driver to change a torque limit of the driver, which is for rotating the pulsator, based on the vertical position of the laundry accommodated in the drum while rotating the drum.

4. The washing apparatus of claim 1, wherein the controller is further configured to control the driver to change the rotational speed of the pulsator based on a drive current of the driver for rotating the drum.

5. The washing apparatus of claim 4, wherein the controller is further configured to control the driver to:

rotate the pulsator at a first rotational speed based on that the drive current is greater than a first reference current during one rotation cycle of the drum, and rotate the pulsator at a second rotational speed, which is higher than the first rotational speed, based on that the drive current is less than a second reference current, which is less than the first reference current, during one rotation cycle of the drum.

6. The washing apparatus of claim 4, wherein the controller is further configured to control the driver to:

rotate the pulsator at a first rotational speed based on that the drive current is a maximum value during one rotation cycle of the drum, and rotate the pulsator at a second rotational speed, which is higher than the first rotational speed, based on that the drive current is a minimum value during one rotation cycle of the drum.

7. The washing apparatus of claim 1, wherein the controller is further configured to control the driver to change a torque limit of the driver, which is for rotating the pulsator, based on a drive current of the driver for rotating the drum.

8. The washing apparatus of claim 1, wherein in a washing cycle or a rinsing cycle of the washing apparatus, the first direction is different from the second direction, and in a spinning cycle of the washing apparatus, the first direction is the same as the second direction.

* * * * *